US011541665B2

(12) United States Patent
Naito et al.

(10) Patent No.: US 11,541,665 B2
(45) Date of Patent: Jan. 3, 2023

(54) LIQUID STORAGE CONTAINER

(71) Applicant: SEIKO EPSON CORPORATION, Tokyo (JP)

(72) Inventors: Naoki Naito, Ikeda-machi (JP); Masahiro Karasawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 4 days.

(21) Appl. No.: 17/233,660

(22) Filed: Apr. 19, 2021

(65) Prior Publication Data

US 2021/0323311 A1 Oct. 21, 2021

(30) Foreign Application Priority Data

Apr. 20, 2020 (JP) ..... JP2020-074595

(51) Int. Cl.
*B41J 2/175* (2006.01)

(52) U.S. Cl.
CPC ..... *B41J 2/17523* (2013.01); *B41J 2/17513* (2013.01); *B41J 2/17563* (2013.01)

(58) Field of Classification Search
CPC ..... B41J 2/17523; B41J 2/17513; B41J 2/17563; B41J 2/17506; B41J 2/1753; B41J 2/17546; B41J 2/17553; B41J 2/17503
USPC ..... 347/86
See application file for complete search history.

(56) References Cited

U.S. PATENT DOCUMENTS 10,464,331 B2 11/2019 Naito et al.
2014/0028763 A1* 1/2014 Hochreiter ..... B41J 2/17513 347/86

FOREIGN PATENT DOCUMENTS

JP 2019-018366 A 2/2019

* cited by examiner

*Primary Examiner* — Kristal Feggins
*Assistant Examiner* — Alexander D Shenderov
(74) *Attorney, Agent, or Firm* — Oliff PLC

(57) ABSTRACT

A liquid storage container includes a storage chamber that stores a liquid, a filter chamber that is provided with a filter and receives the liquid from the storage chamber to filter the liquid by the filter, and a partition wall that separates the storage chamber and the filter chamber. The partition wall is provided with a communication hole structure that allows the storage chamber and the filter chamber to communicate with each other. A shape of one or more openings of the communication hole structure in the storage chamber is a shape in which a distance from a center of gravity of an entirety of the one or more openings to the closest point in a contour defining the one or more openings is smaller than a radius of a circle having the same area as an area of the entirety of the one or more openings.

4 Claims, 20 Drawing Sheets

LIQUID STORAGE CONTAINER

The present application is based on, and claims priority from JP Application Serial Number 2020-074595, filed Apr. 20, 2020, the disclosure of which is hereby incorporated by reference herein in its entirety.

BACKGROUND

1. Technical Field

The present disclosure relates to a liquid storage container.

2. Related Art

In the related art, there is a liquid storage container that stores a liquid to be supplied to a liquid consumption device such as an ink jet printer. A liquid storage container of JP-A-2019-18366 includes a storage chamber that stores a liquid and a filter chamber for capturing foreign substances and air bubbles contained in the liquid and removing them from the liquid. The filter chamber is provided below the storage chamber. The filter chamber is coupled to the storage chamber through a first communication port provided on a bottom surface of the storage chamber. The liquid in the storage chamber uses gravity to flow into the filter chamber through the first communication port. The liquid is supplied from the filter chamber to a liquid consumption device via an outlet flow path and a liquid outlet. With such a configuration, the liquid is supplied to the liquid consumption device after the foreign substances and the air bubbles are removed.

However, in the liquid storage container disclosed in JP-A-2019-18366, when the liquid in the storage chamber is consumed and the liquid level approaches the bottom surface of the storage chamber in a state in which the liquid storage container is tilted, the following problems may occur. That is, while the liquid flows toward the filter chamber near the outer periphery of the communication port, a portion through which air flows is formed in the center of the communication port, and air is drawn into the filter chamber. As a result, the liquid containing air bubbles may be supplied to the liquid consumption device.

SUMMARY

According to an aspect of the present disclosure, there is provided a liquid storage container. The liquid storage container is a liquid storage container that stores a liquid to be supplied to a liquid consumption device that consumes the liquid. The liquid storage container includes a storage chamber that stores a liquid, a filter chamber that is provided with a filter and receives the liquid from the storage chamber to filter the liquid by the filter, and a partition wall that separates the storage chamber and the filter chamber. The partition wall is provided with a communication hole structure that allows the storage chamber and the filter chamber to communicate with each other. A shape of one or more openings of the communication hole structure in the storage chamber is a shape in which a distance from a center of gravity of an entirety of the one or more openings to the closest point in a contour defining the one or more openings is smaller than a radius of a circle having the same area as an area of the entirety of the one or more openings.

DESCRIPTION OF EXEMPLARY EMBODIMENTS

A. First Embodiment

A configuration of a liquid consumption device 500 to which a liquid storage container 10A according to a first embodiment is mounted will be described with reference to FIG. 1, and then a configuration of the liquid storage container 10A according to the first embodiment will be described with reference to FIGS. 2 to 22.

A1. Configuration of Liquid Consumption Device

Figure 1:
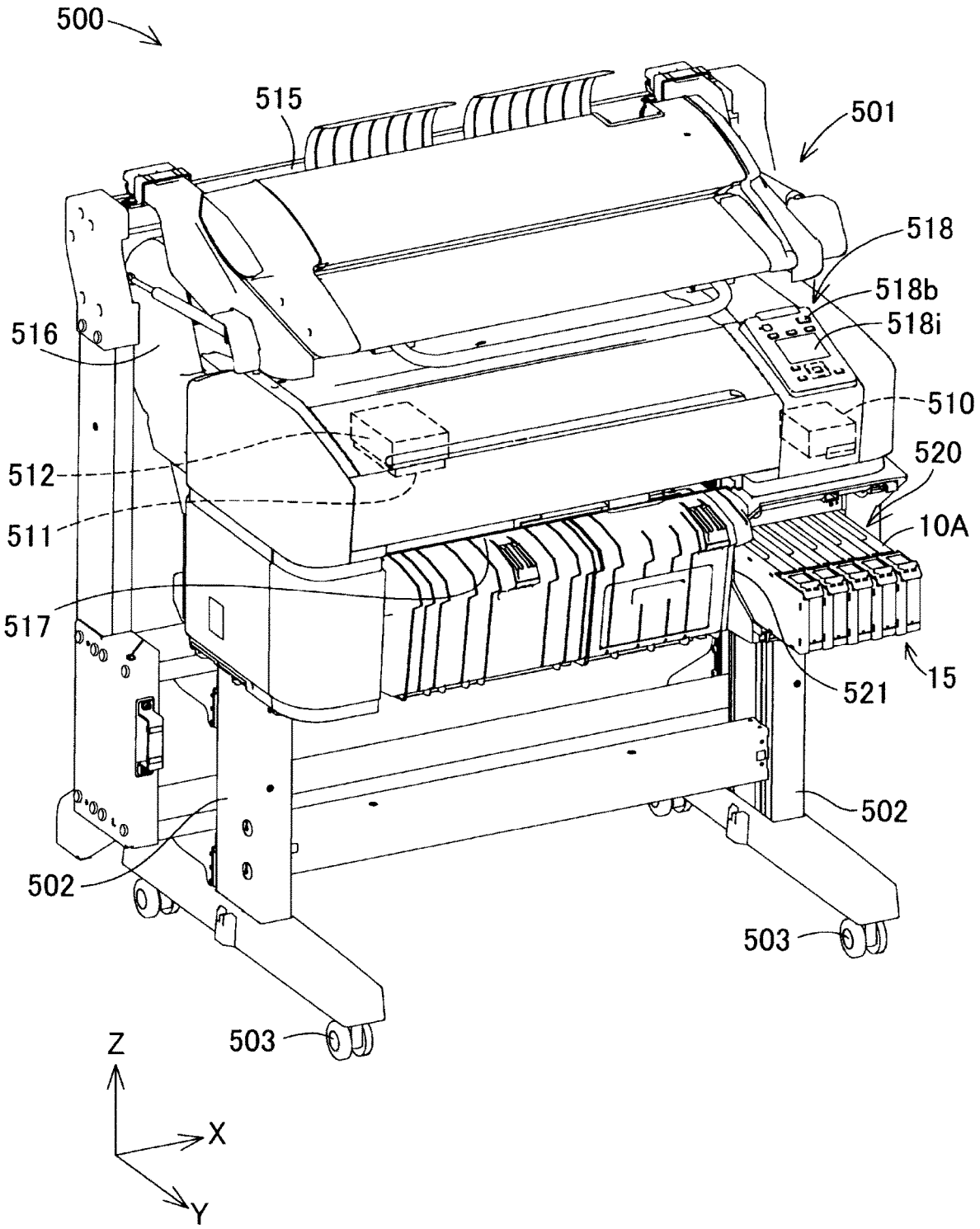
FIG. 1 is a schematic perspective view showing a configuration of a liquid consumption device.

FIG. 1 is a schematic perspective view showing a configuration of a liquid consumption device 500. In FIG. 1, arrows X, Y, and Z indicating three directions orthogonal to each other are shown. Note that the arrows X, Y, and Z are appropriately shown in the other drawings referred to in the present specification so as to correspond to FIG. 1.

The directions indicated by the arrows X, Y, and Z correspond to the arrangement posture of the liquid consumption device 500 in a normal use state. The "normal use state" means a state in which the liquid consumption device 500 is arranged and used on a horizontal plane. The liquid consumption device 500 will be described below based on the posture when it is in a normal use state. Further, in the following description, directions in the directions pointed to by the arrows X, Y, and Z are referred to as an "X direction," a "Y direction," and a "Z direction," respectively. The direction pointed by the arrow X in each X direction is referred to as a "+X direction," and its opposite direction is referred to as a "−X direction". Similarly, for the Y and Z directions, the directions pointed to by the arrows Y and Z are referred to as a "+Y direction" and a "+Z direction," and their opposite directions are referred to as a "−Y direction" and a "−Z direction," respectively.

The X, Y, and Z directions will be described in the order of the Z direction, the Y direction, and the X direction. The Z direction indicates a direction parallel to the direction of gravity. The +Z direction is the direction of gravity, and the −Z direction is the direction opposite to the direction of gravity. In the present specification, the term "up" or "down" basically means a vertical direction with respect to the direction of gravity. The Y direction indicates a direction parallel to the horizontal plane, and indicates a front-rear direction (a depth direction) of the liquid consumption device 500. The −Y direction is a direction from the front side to the rear side of the liquid consumption device 500, which is supposed to be faced by a user of the liquid consumption device 500. The +Y direction is a direction from the rear side to the front side of the liquid consumption device 500. The X direction indicates a direction parallel to the horizontal plane, and indicates a right-left direction (a width direction) of the liquid consumption device 500. The +X direction indicates a direction from the left side to the right side when facing the front surface of the liquid consumption device 500, and the −X direction indicates a direction from the right side to the left side.

The liquid consumption device 500 according to the first embodiment is a device that consumes a liquid. More specifically, the liquid consumption device 500 is an ink jet printer. The liquid consumed by the liquid consumption device 500 is an ink. The liquid consumption device 500 ejects an ink toward a medium and records ink dots on the medium to form an image. The medium is, for example, printing paper.

The liquid consumption device 500 includes a device main body 501 and legs 502. In the first embodiment, the device main body 501 has a shape with the X direction as a longitudinal direction, and has the largest width in the X direction. The legs 502 are provided below the device main body 501 and horizontally support the device main body 501. The legs 502 are provided with wheels 503 for facilitating the movement of the liquid consumption device 500.

The device main body 501 includes a control portion 510, a head 511, and a carriage 512 provided inside. In FIG. 1, for the sake of convenience, the arrangement positions of the control portion 510, the head 511, and the carriage 512 are illustrated by broken lines. The control portion 510 controls the drive of each component in the liquid consumption device 500. The control portion 510 is configured by a microcomputer at least including a central processing unit and a main storage device. The control portion 510 exerts various functions by the central processing unit reading various programs into the main storage device and executing them. The control portion 510 may be configured by a circuit instead of the microcomputer.

The head 511 ejects a liquid toward the surface of a medium (not shown) that is transported below the head. The head 511 includes a liquid chamber that stores a liquid and a plurality of nozzles that open downward at the bottom surface of the liquid chamber (not shown). Under the control of the control portion 510, the head 511 ejects the liquid from the nozzle by a known method such as applying a pressure to the liquid in the liquid chamber by a piezo element, for example.

The carriage 512 mounts the head 511 on the lower surface thereof and transports the head 511 in a main operation direction under the control of the control portion 510. In the first embodiment, a main scanning direction of the liquid consumption device 500 is the direction in the X direction. As a drive mechanism for moving the carriage 512, the device main body 501 includes a guide shaft that guides the movement of the carriage 512, a motor that generates a driving force for moving the carriage 512, and a pulley that transmits the driving force to the carriage 512. Note that, illustration and detailed description about them will be omitted.

An insertion port 515 for introducing a medium from the outside is provided at an upper end portion of the device main body 501 on the −Y direction side. The insertion port 515 is provided as a slit-shaped opening portion that extends in the X direction and opens in the +Z direction. A medium accommodating portion 516 is provided below the insertion port 515. Inside the medium accommodating portion 516, a medium different from the medium introduced from the insertion port 515 is housed in a rolled state (not shown). A discharge port 517 from which the medium is discharged is provided on the front surface of the device main body 501. The discharge port 517 is provided as a slit-shaped opening portion that extends in the X direction and opens in the +Y direction.

In the liquid consumption device 500, the medium inserted from the insertion port 515 or the medium housed in the medium accommodating portion 516 is transported below the head 511 by a transport roller (not shown) provided inside the device main body 501. The medium is transported in the Y direction in the region below the head 511. In the first embodiment, a sub-scanning direction of the liquid consumption device 500 is the direction in the Y direction. The medium passes through the lower region of the head 511 and is discharged from the discharge port 517.

In the liquid consumption device 500, the control portion 510 reciprocates the head 511 in the main scanning direction while transporting the medium in the sub-scanning direction described above in the lower region of the head 511, and ejects ink droplets from the head 511 at a predetermined timing based on print data. As a result, ink dots are recorded on the medium at positions determined based on the print data, and an image is formed based on the print data.

An operation portion 518 is provided on the front surface of the device main body 501. In the first embodiment, the operation portion 518 is provided at the end portion on the +X direction side. The operation portion 518 includes a display portion **518*i* that displays information for a user, and a plurality of operation buttons 518*b*** that receive the user's operation.

The device main body 501 includes a liquid supply portion 520. In the first embodiment, the liquid supply portion 520 is provided below the operation portion 518 so that a user who operates the operation portion 518 can easily access the liquid supply portion. The liquid supply portion 520 supplies the liquid to be ejected to the head 511. A plurality of liquid storage containers 10A are detachably mounted on the liquid supply portion 520. In FIG. 1, a state in which five liquid storage containers 10A are mounted is illustrated.

The liquid storage container 10A stores the liquid to be supplied to the liquid consumption device 500. The liquid supply portion 520 includes a suction pump, and sucks the liquid in the liquid storage container 10A through a flexible tube 513 by the suction pump and supplies the liquid to the head 511.

A container insertion port 521 into which the liquid storage container 10A to be mounted is inserted is open in the +Y direction on the front surface of the device main body 501. In the liquid consumption device 500, the plurality of liquid storage containers 10A are configured to be inserted in parallel with the container insertion port 521 of the liquid supply portion 520 in a state of being arranged in the X direction. The respective liquid storage containers 10A store inks of different colors.

In the liquid consumption device 500, the liquid storage container 10A is inserted into the liquid consumption device 500 in a direction intersecting the direction of gravity. In the first embodiment, the direction in which the liquid storage container 10A is inserted into the liquid consumption device 500 is the −Y direction. Hereinafter, the −Y direction, which is the direction in which the liquid storage container 10A is inserted into the liquid consumption device 500, is also simply referred to as an "insertion direction".

In the liquid consumption device 500, each liquid storage container 10A is mounted on the liquid consumption device 500 in a state in which a portion thereof protrudes in the insertion direction. Hereinafter, the state in which each liquid storage container 10A is appropriately mounted on the liquid consumption device 500 is also simply referred to as a "mounted state". The details of the mechanism for mounting the liquid storage container 10A on the liquid consumption device 500 will be described later.

A2. Configuration of Liquid Storage Container

A2-1. Outline of External Configuration of Liquid Storage Container

Figure 2:
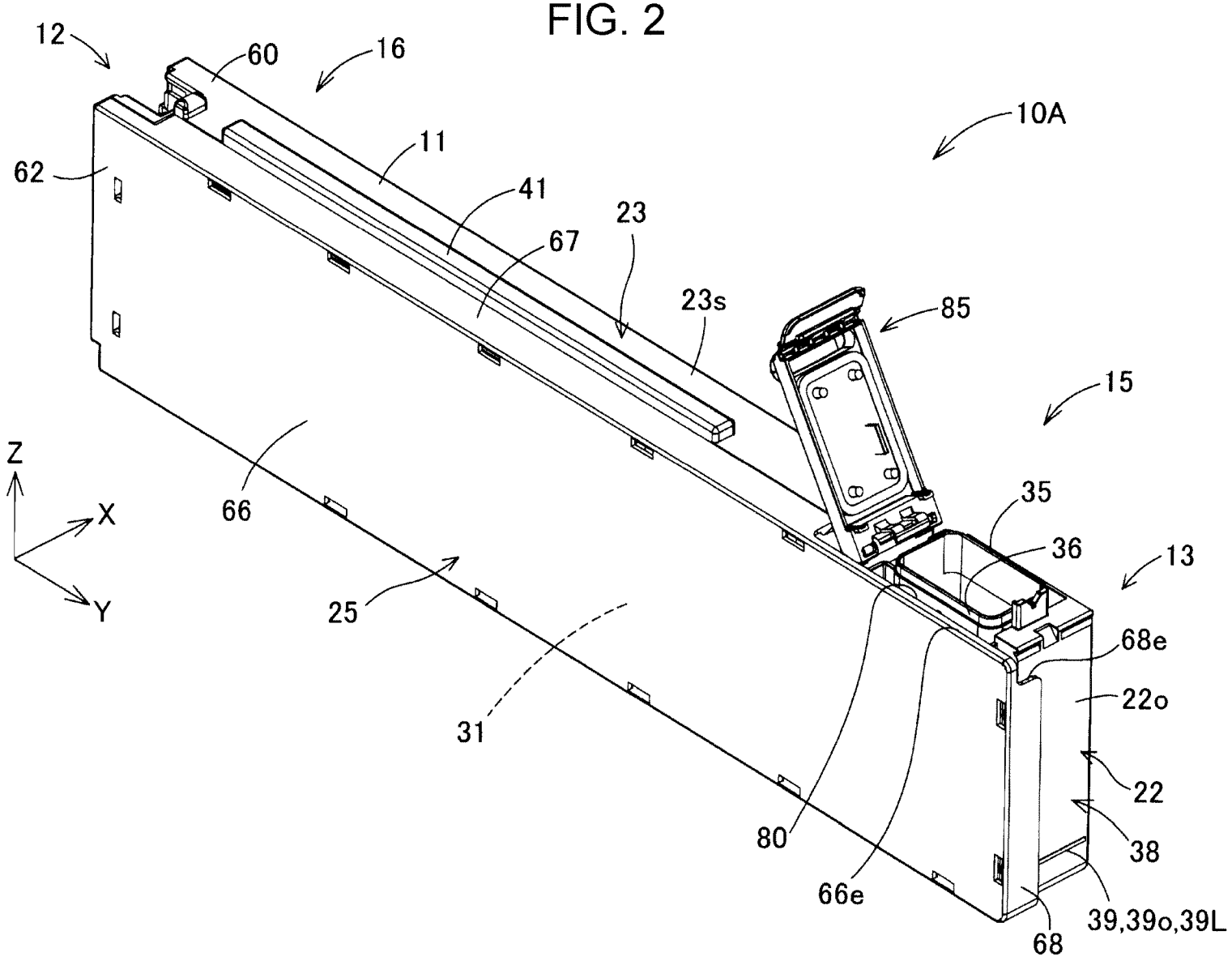
FIG. 2 is a first schematic perspective view of a liquid storage container according to a first embodiment.
Figure 3:
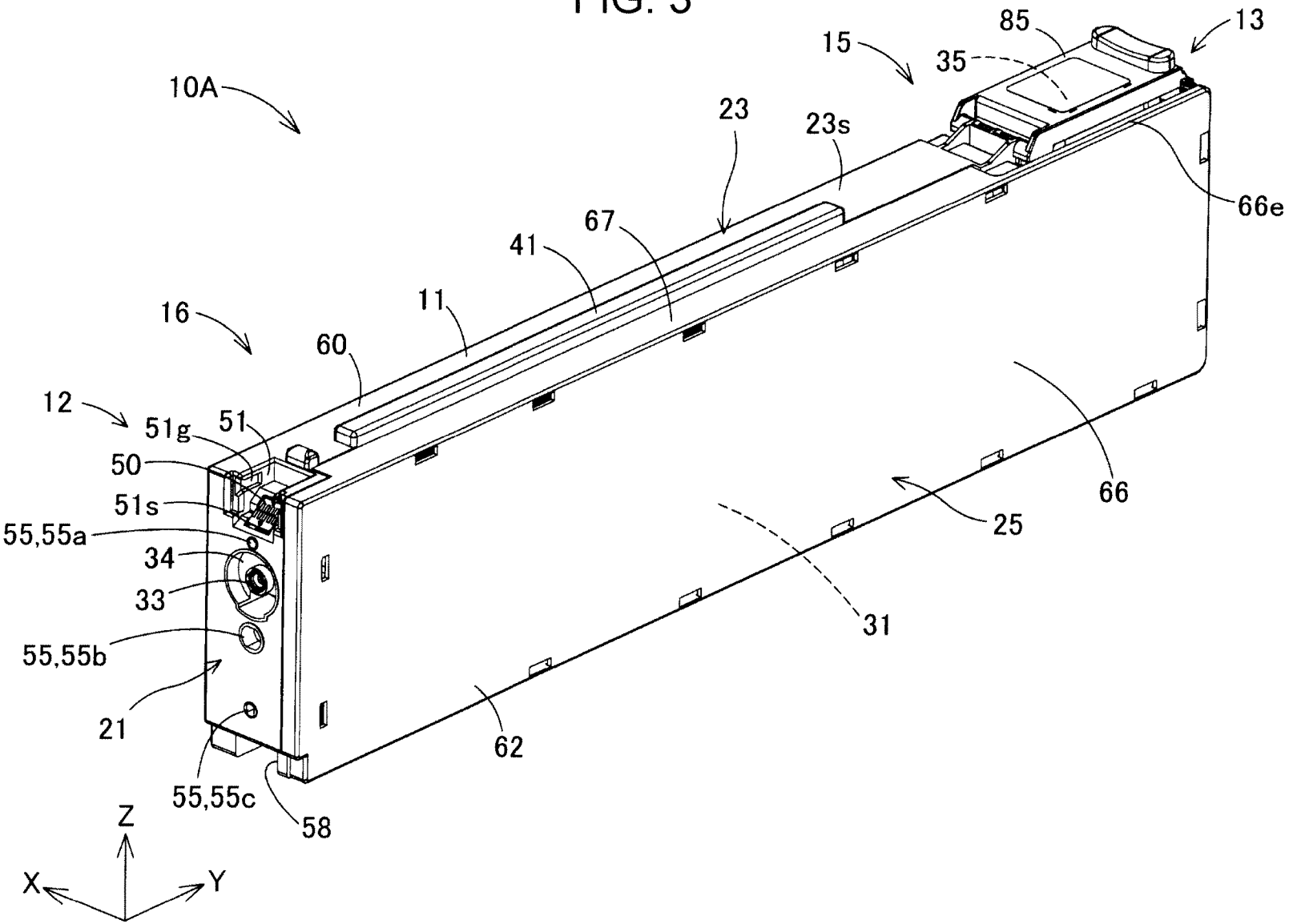
FIG. 3 is a second schematic perspective view of the liquid storage container according to the first embodiment.
Figure 4:
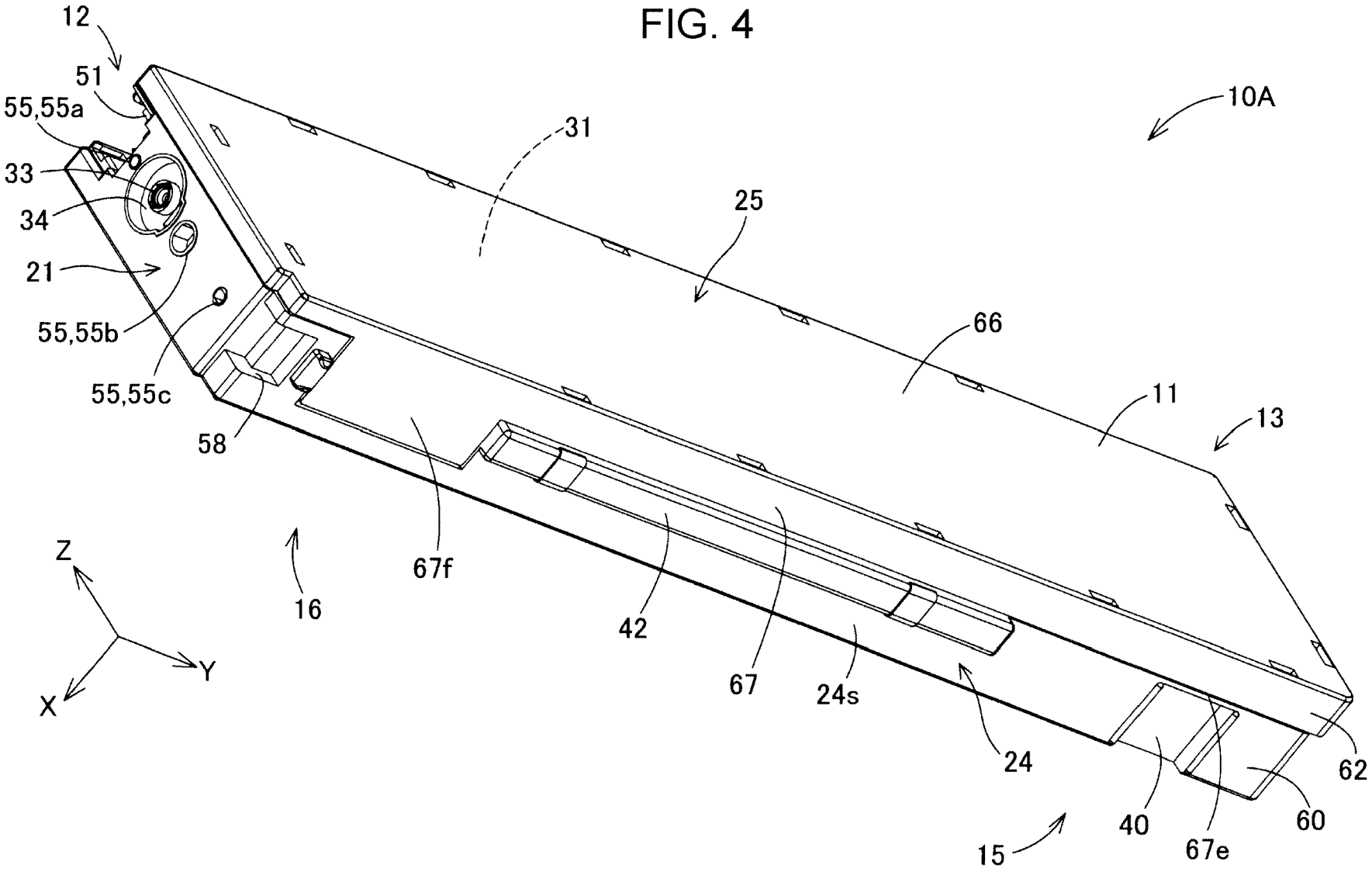
FIG. 4 is a third schematic perspective view of the liquid storage container according to the first embodiment.
Figure 5:
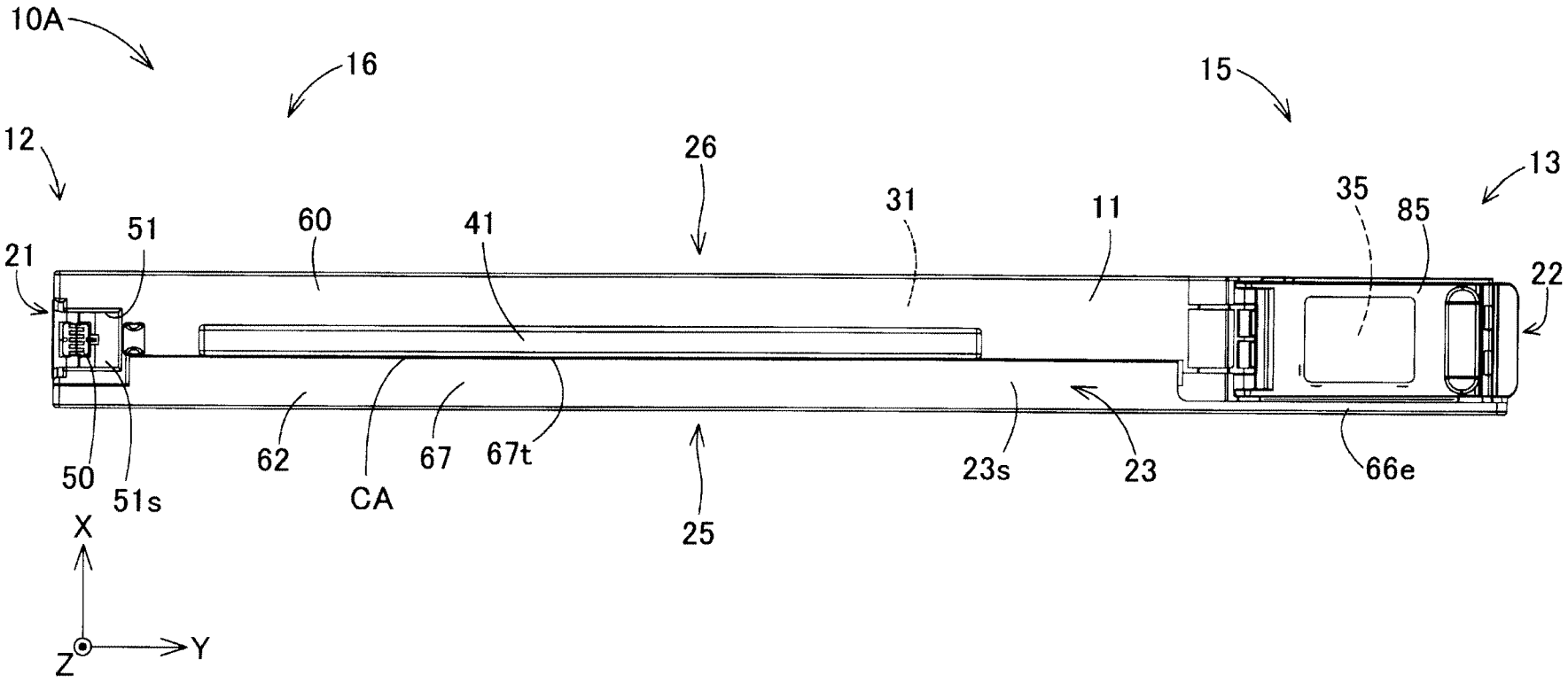
FIG. 5 is a schematic plan view of the liquid storage container according to the first embodiment.
Figure 6:
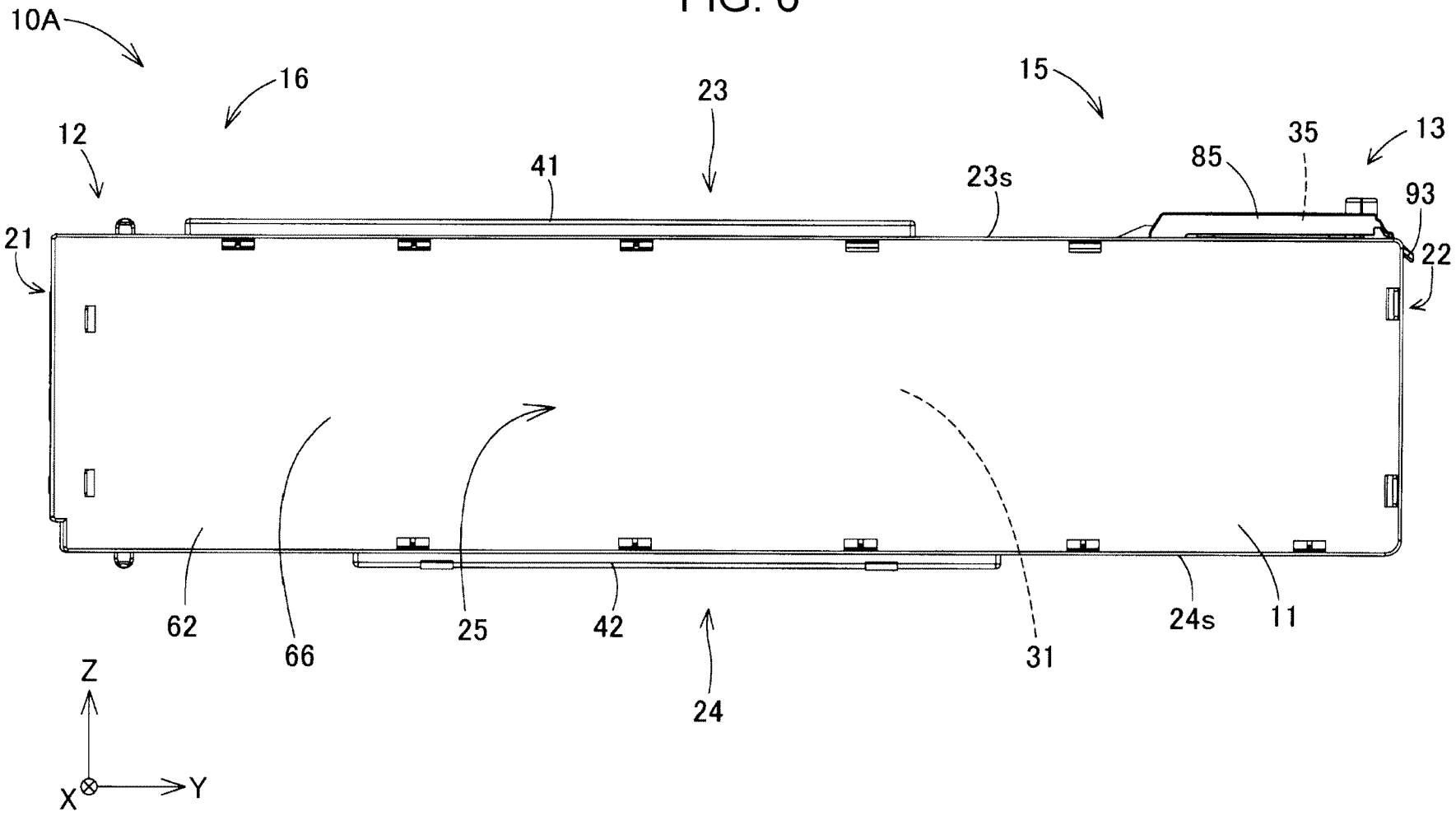
FIG. 6 is a schematic side view of the liquid storage container according to the first embodiment.
Figure 7:
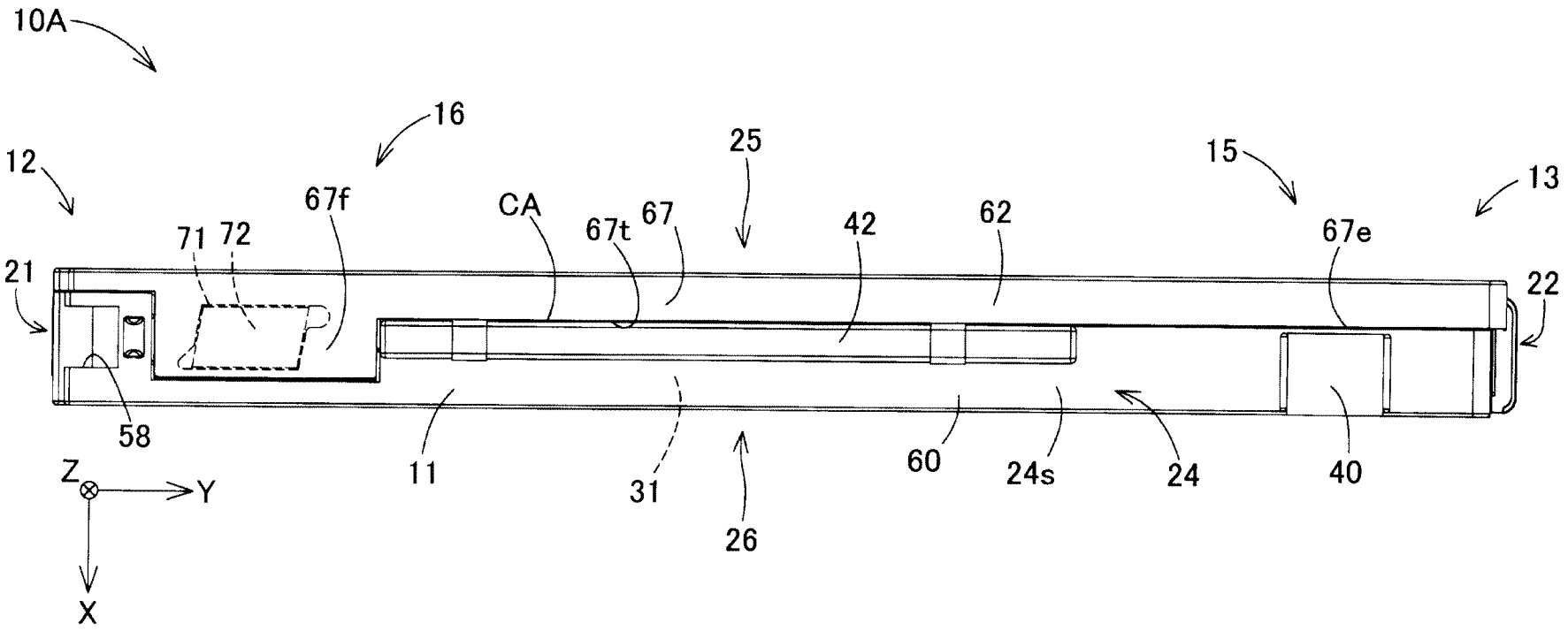
FIG. 7 is a schematic bottom view of the liquid storage container according to the first embodiment.
Figure 8:
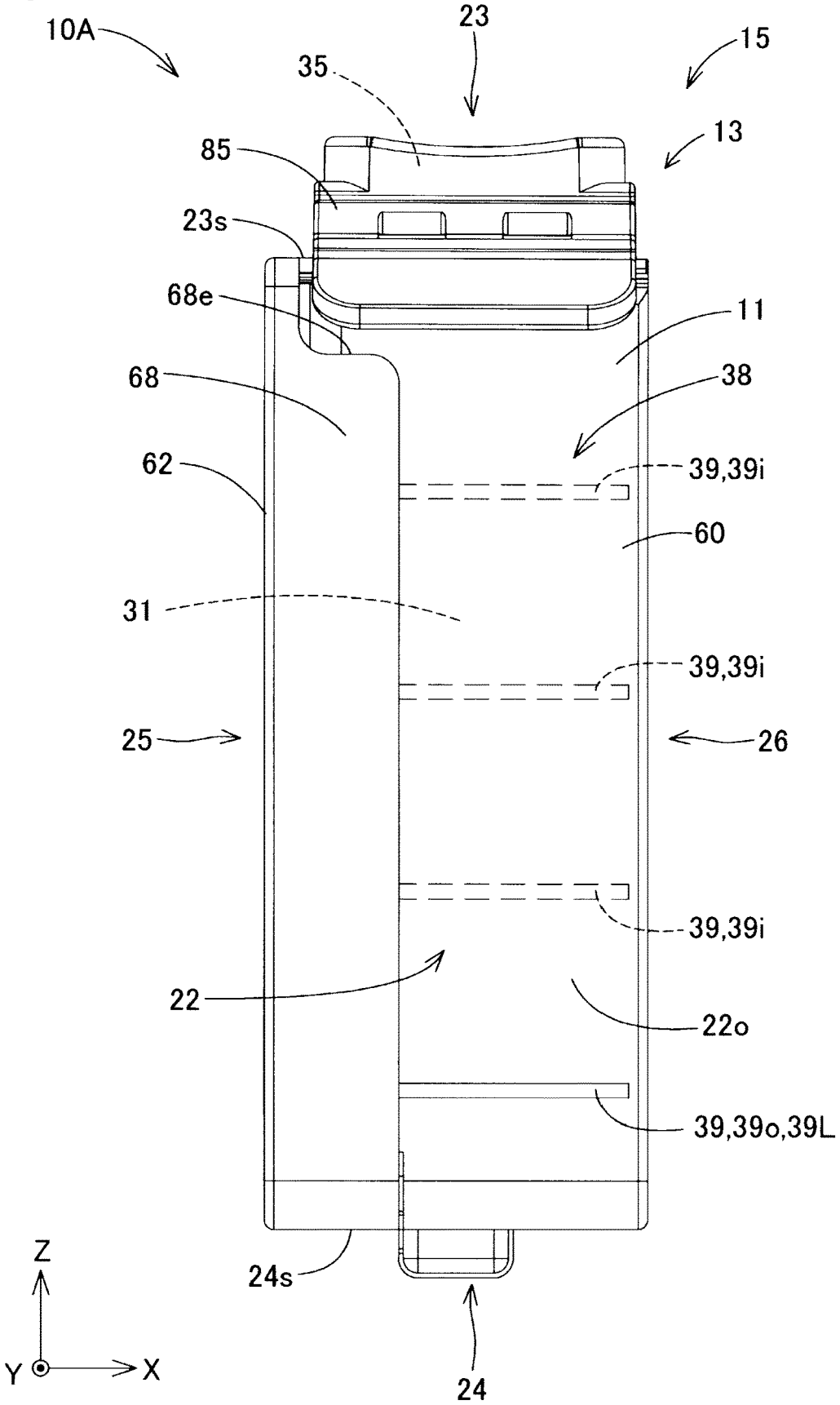
FIG. 8 is a schematic front view of the liquid storage container according to the first embodiment.
Figure 9:
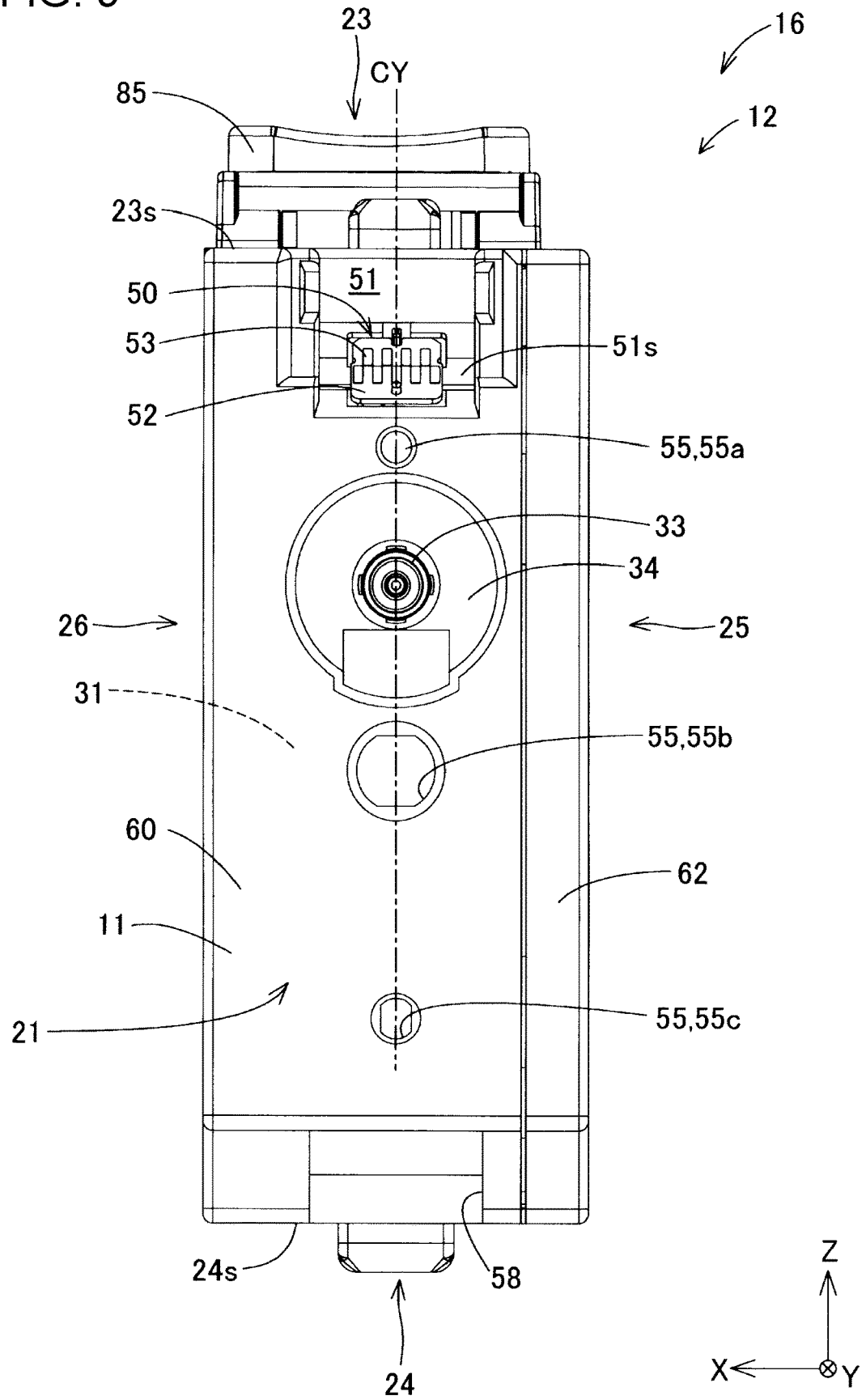
FIG. 9 is a schematic rear view of the liquid storage container according to the first embodiment.

The outline of an external configuration of each liquid storage container 10A will be described with reference to FIGS. 2 to 9. FIG. 2 is a schematic perspective view of the liquid storage container 10A when viewed from the +Y direction side and the +Z direction side. FIG. 3 is a schematic perspective view of the liquid storage container 10A when viewed from the −Y direction side and the +Z direction side. FIG. 4 is a schematic perspective view of the liquid storage container 10A when viewed from the −Y direction side and the −Z direction side. FIG. 5 is a schematic plan view of the liquid storage container 10A when viewed in the −Z direction. FIG. 6 is a schematic side view of the liquid storage container 10A when viewed in the +X direction. FIG. 7 is a schematic bottom view of the liquid storage container 10A when viewed in the +Z direction. FIG. 8 is a schematic front view of the liquid storage container 10A when viewed in the −Y direction. FIG. 9 is a schematic rear view of the liquid storage container 10A when viewed in the +Y direction. In the present specification, all the descriptions in the X, Y, and Z directions regarding the liquid storage container 10A are based on the arrangement posture of the liquid storage container 10A in the mounted state, which is mounted on the liquid consumption device 500 in the normal use state.

A2-1-1. Wall Portion of Container Body

Figure 10:
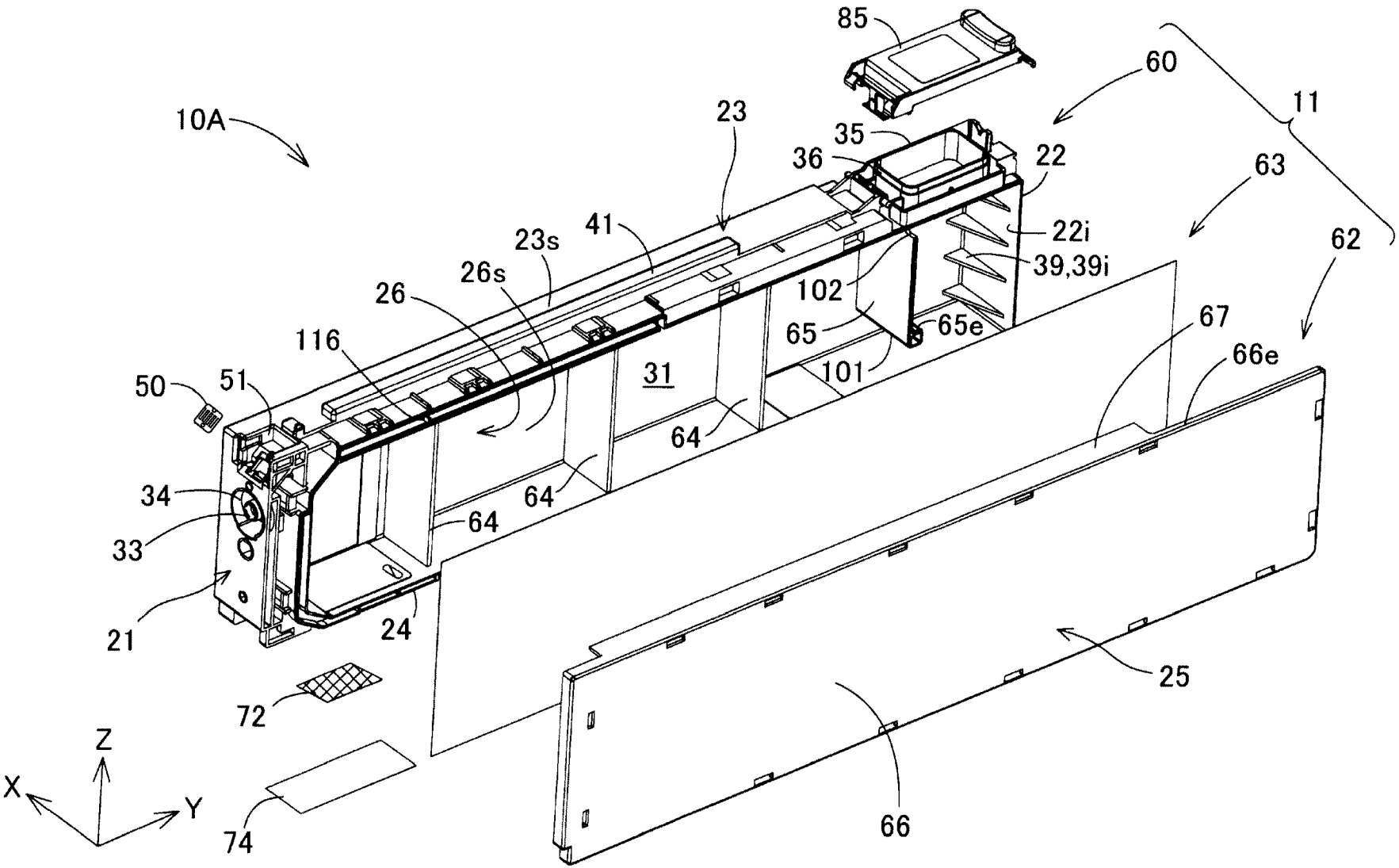
FIG. 10 is a schematic exploded perspective view of the liquid storage container according to the first embodiment.
Figure 11:
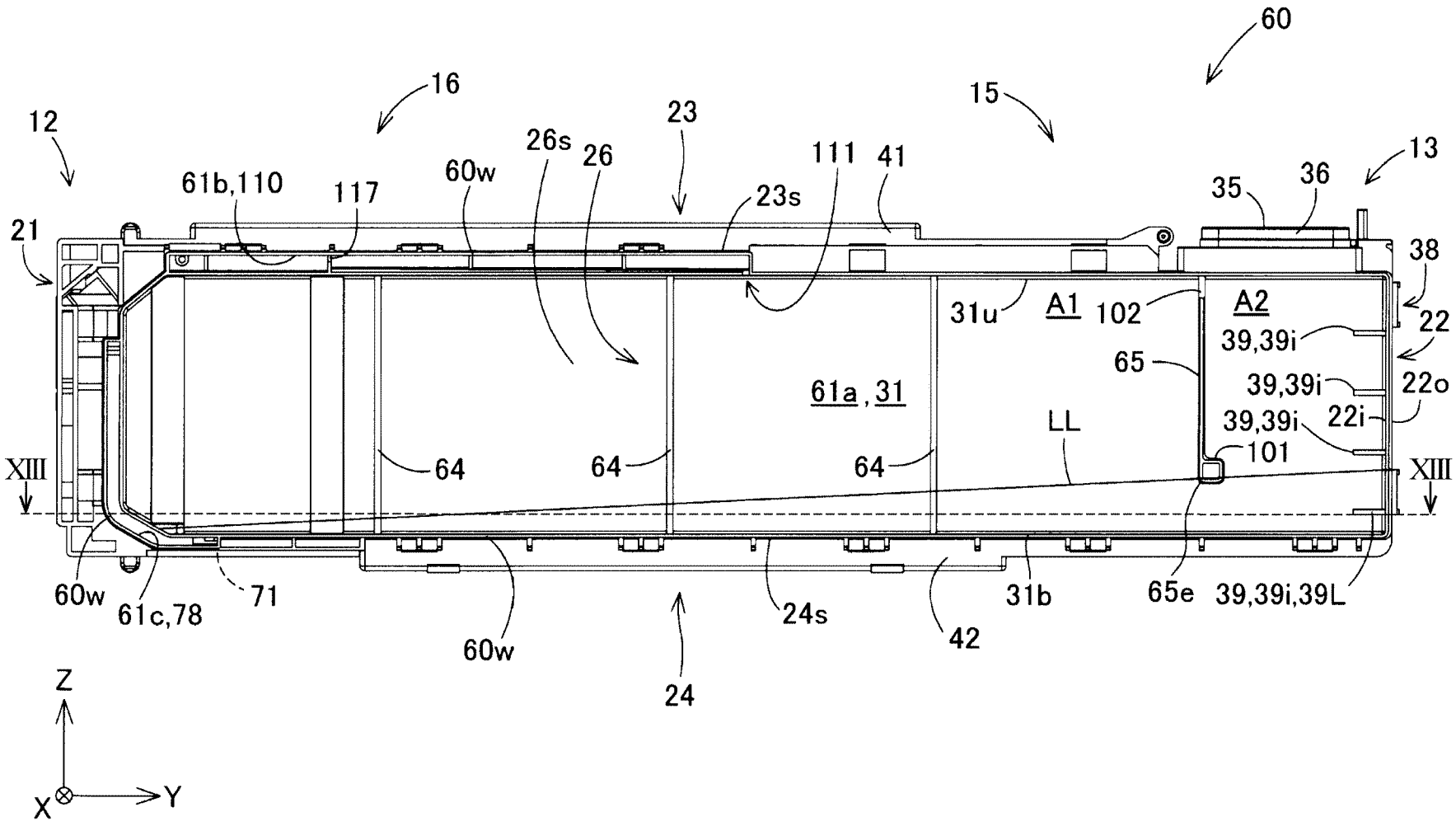
FIG. 11 is a schematic side view of an opening housing member.
Figure 12:
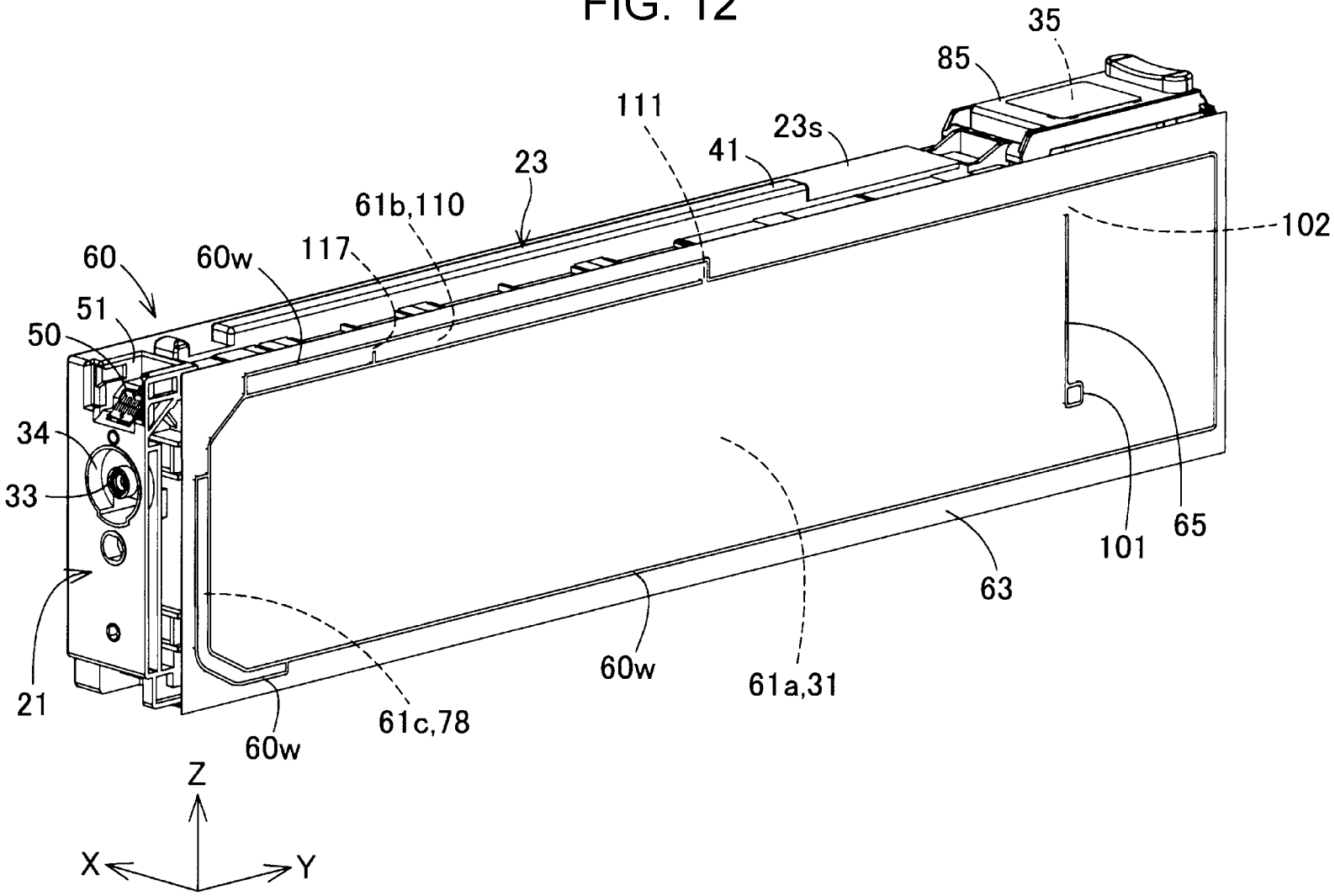
FIG. 12 is a schematic perspective view showing the opening housing member to which a film member is welded.

The liquid storage container 10A includes a container body 11 in which a storage chamber 31 that stores a liquid is provided inside. In FIGS. 2 to 9, for the sake of convenience, the position of the storage chamber 31 is indicated by a broken line. The storage chamber 31 is shown in FIGS. 10 to 12, which will be referred to later.

The container body 11 has a shape in which the Y direction in the insertion direction is the longitudinal direction. That is, the container body 11 has a shape in which the length in the Y direction is longer than the length in the X and Z directions. In the first embodiment, the container body 11 has a substantially rectangular parallelepiped shape, and the length in the Y direction is larger than the width in the X direction and the height in the Z direction (refer to FIGS. 2 to 4). The width of the container body 11 in the X direction is smaller than the height in the Z direction (refer to FIGS. 8 and 9). The container body 11 is made of a resin member such as polypropylene (PP).

The container body 11 includes a first end portion 12 and a second end portion 13 which are end portions in the longitudinal direction thereof (refer to FIGS. 2 to 7). The first end portion 12 is an end portion on the insertion direction side, that is, on the −Y direction side. The second end portion 13 is an end portion on the side opposite to the insertion direction, that is, on the +Y direction side.

The container body 11 includes a first portion 15 and a second portion 16 (refer to FIGS. 2 to 7). The first portion 15 is a portion exposed to the outside of the liquid consumption device 500 when the liquid storage container 10A is in the mounted state, and is a portion on the −Y direction side with respect to the container insertion port 521 (refer to FIG. 1). The second portion 16 is a portion housed inside the liquid consumption device 500 when the liquid storage container 10A is in the mounted state, and is a portion on the +Y direction side with respect to the container insertion port 521. The first end portion 12 described above is included in the first portion 15, and the second end portion 13 is included in the second portion 16.

The container body 11 includes six wall portions 21 to 26 to be described below as a plurality of wall portions. In the present specification, the wall surface of the "wall portion" does not have to be formed in a flat shape, may be formed in a curved shape, and may have a recess, a protrusion, a step, a groove, a bent portion, an inclined surface, a hole, a slit, and the like. Further, in the following description, a state in which wall portions "intersect" means any of a state in which the wall surfaces of the wall portions actually intersect with each other, a state in which the extension surface of the wall surface of one wall portion intersects the wall surface of the other wall portion, and a state in which the extension surfaces of the wall surfaces of two wall portions intersect with each other. A chamfered portion or the like forming a curved surface may be interposed between the intersecting wall portions.

The first wall portion 21 is a tip end wall portion, is located on the insertion direction side of the storage chamber 31, and has an outer wall surface facing the insertion direction (refer to FIGS. 3 to 7 and 9). The second wall portion 22 is a rear end wall portion, and is located on the side opposite to the first wall portion 21 with the storage chamber 31 interposed therebetween in the insertion direction, and has an outer wall surface 22*o* facing in the direction opposite to the insertion direction (refer to FIGS. 2 and 8). As shown in FIGS. 10 and 11 which will be referred to later, an inner wall surface 22*i* of the second wall portion 22 opposite to the outer wall surface 22*o* faces the storage chamber 31.

The third wall portion 23 is an upper surface wall portion, and intersects the first wall portion 21 and the second wall portion 22 at both ends in the Y direction (refer to FIGS. 2, 3, and 5). The third wall portion 23 has an upper wall surface 23*s*. The upper wall surface 23*s* is an outer wall surface of the liquid storage container 10A in the insertion direction, which is located above the storage chamber 31, and faces upward.

The fourth wall portion 24 is a bottom surface wall portion, intersects the first wall portion 21 and the second wall portion 22 at both ends in the Y direction, and faces the third wall portion 23 with the storage chamber interposed therebetween in the Z direction (refer to FIGS. 4, 6, and 7). In the present specification, the term "facing" includes a state in which objects facing each other are directly facing each other, and a state in which other objects are interposed between the objects facing each other to indirectly face each other. The fourth wall portion 24 has a bottom wall surface 24*s*. The bottom wall surface 24*s* is an outer wall surface of the liquid storage container 10A in the insertion direction, which is located below the storage chamber 31, and faces downward.

The fifth wall portion 25 is a left side wall portion, and is located on the left side of the storage chamber 31 when the liquid storage container 10A is viewed in the insertion direction (refer to FIGS. 2 and 8). The fifth wall portion 25 intersects the first wall portion 21, the second wall portion 22, the third wall portion 23, and the fourth wall portion 24 (refer to FIGS. 2 and 3).

The sixth wall portion 26 is a right side wall portion, and is located on the right side of the storage chamber 31 when the liquid storage container 10A is viewed in the insertion direction (refer to FIGS. 5, 7, and 8). The sixth wall portion 26 intersects the first wall portion 21, the second wall portion 22, the third wall portion 23, and the fourth wall portion 24, and faces the fifth wall portion 25 with the storage chamber 31 interposed therebetween in the X direction.

A2-1-2. Liquid Outlet

The liquid storage container 10A includes a liquid outlet 33 (refer to FIGS. 3, 4, and 9). The liquid outlet 33 is coupled to the liquid consumption device 500 in the mounted state, and causes the liquid in the storage chamber 31 to flow out to the liquid consumption device 500. The liquid outlet 33 is provided on the first end portion 12 side of the container body 11 in the insertion direction. The liquid outlet 33 is open in the insertion direction at the first wall portion 21. The liquid outlet 33 is provided in the recess 34 recessed in the +Y direction in the first wall portion 21. Hereinafter, the recess 34 is also referred to as an "outlet housing recess 34". A configuration of the liquid flow path coupling the storage chamber 31 provided inside the container body 11 and the liquid outlet 33 and a function of the outlet housing recess 34 will be described later.

A2-1-3. Liquid Inlet

The liquid storage container 10A includes a liquid inlet 35 (refer to FIGS. 2, 3, and 5). FIG. 2 shows a state in which a lid member 85 is opened and the liquid inlet 35 is open, and FIG. 3 shows a state in which the lid member 85 is closed and the liquid inlet 35 is closed. In FIGS. 3 and 5, for the sake of convenience, the position of the liquid inlet 35 is indicated by a broken line.

The liquid inlet 35 communicates with the storage chamber 31. The liquid inlet 35 receives pouring of the liquid from the outside of the container body 11 into the storage chamber 31 by a user. The liquid inlet 35 is provided on the second end portion 13 side of the container body 11 in the insertion direction. The liquid inlet 35 is provided at a position closer to the second wall portion 22, which is the rear end wall portion, than the first wall portion 21, which is the tip end wall portion, in the third wall portion 23, which is the upper surface wall portion. The circumference of the liquid inlet 35 is surrounded by an inlet peripheral wall portion 36. The inlet peripheral wall portion 36 is a tubular wall portion that projects upward in the third wall portion 23.

The liquid inlet 35 is located at the first portion 15 exposed to the outside of the liquid consumption device 500 in the mounted state (refer to FIG. 1). Therefore, a user can replenish the liquid storage container 10A with the liquid while the liquid storage container 10A is mounted on the liquid consumption device 500. A configuration around the liquid inlet 35 including the lid member 85 and an operation of pouring the liquid into the liquid inlet 35 by the user will be described later.

A2-2. Outline of Assembly Structure and Internal Structure of Liquid Storage Container The outline of the assembly structure of the liquid storage container 10A and the internal structure thereof will be described with reference to FIGS. 10 to 12. FIG. 10 is a schematic exploded perspective view of the liquid storage container 10A. FIG. 11 is a schematic side view of an opening housing member 60 when viewed in the +X direction. FIG. 12 is a schematic perspective view showing the opening housing member 60 to which a film member 63 is welded.

The container body 11 of the liquid storage container 10A is composed of the opening housing member 60, a container lid member 62, and the film member 63 (refer to FIG. 10). The opening housing member 60 is a box-shaped member having a substantially rectangular parallelepiped shape, and is open in the −X direction, which is a direction intersecting the insertion direction (refer to FIGS. 10 and 11).

The opening housing member 60 includes a wall portion forming the first wall portion 21, the second wall portion 22, the third wall portion 23, the fourth wall portion 24, and the sixth wall portion 26 of the liquid storage container 10A (refer to FIGS. 10 and 11). The aforementioned liquid outlet 33 and liquid inlet 35, a recess 51 in which an electrical coupling portion 50 is disposed, rail portions 41 and 42, a handle portion 40, and a plurality of recesses 55 are provided in the opening housing member 60.

The opening housing member 60 has three recesses 61*a*, 61*b*, and 61*c* that are recessed in the +X direction and open in the −X direction (refer to FIG. 11). The first recess 61*a* is open in a direction intersecting the insertion direction between the wall portion forming the third wall portion 23, which is the upper surface wall portion, and the wall portion forming the fourth wall portion 24, which is the bottom surface wall portion. The internal space of the first recess 61*a* forms the storage chamber 31. Hereinafter, the first recess 61*a* is also referred to as a "storage chamber recess 61*a*". The internal space of the storage chamber recess 61*a* has a substantially rectangular parallelepiped shape. The internal space of the storage chamber recess 61*a* is formed over almost the entire opening housing member 60. The storage chamber 31 is formed in a shape extending in the longitudinal direction of the container body 11 inside the container body 11 by the storage chamber recess 61*a*.

A plurality of reinforcing wall portions 64 are provided in the storage chamber recess 61*a* (refer to FIGS. 10 and 11). The reinforcing wall portion 64 functions as a rib that suppresses deformation of the wall portion of the opening housing member 60. In the first embodiment, three reinforcing wall portions 64 are provided. Each reinforcing wall portion 64 extends over the Z direction in the storage chamber recess 61*a*. In the present specification, the term "extending" means a state of extending seamlessly in a certain direction. The reinforcing wall portions 64 are arranged in the storage chamber recess 61 at predetermined intervals in the Y direction.

Each reinforcing wall portion 64 is connected to the wall portion forming the third wall portion 23, the wall portion forming the fourth wall portion 24, and the wall portion forming the sixth wall portion 26. The end surface of each reinforcing wall portion 64 on the −X direction side is located on the +X direction side with respect to the end surface of each of the wall portions forming the first wall portion 21, the second wall portion 22, the third wall portion 23, and the fourth wall portion 24 on −X direction side. The end surface of each reinforcing wall portion 64 on the −X direction side is not welded to the film member 63 (refer to FIG. 12). In the liquid storage container 10A, the liquid can be distributed in the Y direction in the storage chamber 31 by forming a space between the entire end surface of each reinforcing wall portion 64 on the −X direction side and the film member 63. In the liquid storage container 10A, a recess recessed in the +X direction may be provided on the end surface of the reinforcing wall portion 64 on the −X direction side, and the film member 63 may be welded to a portion of the end surface of the reinforcing wall portion 64 on the −X direction side other than the recess. In the case of this configuration, the recess functions as a flow path through which the liquid flows in the storage chamber 31.

An inner wall portion 65 is provided in the storage chamber recess 61*a* (refer to FIGS. 10 and 11). The inner wall portion 65 hangs down from an upper surface 31*u* side of the storage chamber 31 toward a bottom surface 31*b*, and a lower end 65*e* thereof is located between an upper surface 31*u* and the bottom surface 31*b* of the storage chamber 31. The inner wall portion 65 extends over the entire storage chamber recess 61*a* in the X direction. The end portion of the inner wall portion 65 on the +X direction side is connected to an inner wall surface 26*s*, which is the wall surface of the sixth wall portion 26 on the storage chamber 31 side. The end portion of the inner wall portion 65 on the −X direction side is welded and connected to the film member 63 (refer to FIG. 10) forming the inner wall surface on the −X direction side of the storage chamber 31.

The internal space of the storage chamber recess 61*a*, that is, the storage chamber 31, is partitioned into two regions A1 and A2 adjacent to each other in the insertion direction with the inner wall portion 65 interposed therebetween (refer to FIG. 11). The inner wall portion 65 is provided at a position closer to the second wall portion 22 than the first wall portion 21 in the insertion direction. The inner wall portion 65 is located on the insertion direction side of the liquid inlet 35. In the first embodiment, the inner wall portion 65 hangs down from the upper surface 31*u* of the storage chamber 31 below the inlet peripheral wall portion 36 located on the insertion direction side of the liquid inlet 35. Details of a configuration and functions of the inner wall portion 65 will be described later. The plurality of reinforcing wall portions 64 described above are provided in the region A1 on the −Y direction side of the inner wall portion 65.

The internal space of the second recess 61*b* forms an air introduction portion 110 which is a passage for introducing outside air into the storage chamber 31. The second recess 61*b* is provided above the storage chamber recess 61*a*. The width of the second recess 61*b* in the Z direction is significantly smaller than the width of the storage chamber recess 61*a* in the Z direction. The second recess 61*b* extends from the center of the storage chamber 31 toward the first wall portion 21 in the Y direction. Details of the air introduction portion 110 composed of the second recess 61*b* will be described later.

The third recess 61*c* forms a portion of an outlet flow path 78, which is a liquid flow path coupling a filter chamber 71 and the liquid outlet 33. In FIG. 11, since the liquid outlet 33 and the filter chamber 71 are hidden and cannot be seen, their positions are indicated by broken lines. A configuration of the filter chamber 71 will be described later. The third recess 61*c* bends in the +Z direction along the corner portion of the storage chamber recess 61*a* from the lower end region of the end portion of the storage chamber recess 61*a* on the −Y direction side, and extends in the +Z direction to the liquid outlet 33.

Opening portions of the three recesses 61*a*, 61*b*, and 61*c* of the opening housing member 60 are commonly closed by the film member 63 (refer to FIG. 12). The film member 63 is made of a material having flexibility, gas barrier properties, and liquid impermeable properties. The film member 63 is made of, for example, a resin film such as polyethylene terephthalate (PET), nylon, or polyethylene.

The film member 63 is welded to the end surface of a wall portion 60*w* surrounding each of the three recesses 61*a*, 61*b*, and 61*c* of the opening housing member 60 (refer to FIG. 12). The wall portion 60*w* protrudes in the −X direction, and the positions of its end surfaces are aligned in the −X direction. The film member 63 is welded to the end surface of the inner wall portion 65 on the −X direction side. The position of the end surface of the wall portion 60*w* in the −X direction and the position of the end surface of the inner wall portion 65 in the −X direction are aligned in the −X direction.

In the liquid storage container 10A according to the first embodiment, a space forming the storage chamber 31, the air introduction portion 110, and the outlet flow path 78 is simply formed inside the container body 11 by welding the film member 63 to the opening housing member 60. In the liquid storage container 10A, the sealing property of the liquid in the storage chamber 31 is improved by welding the film member 63 thereto. Further, by using the lightweight and thin film member 63, the weight and size of the liquid storage container 10A have been reduced.

In the liquid storage container 10A, the film member 63 welded to the opening housing member 60 is covered with the container lid member 62 (refer to FIG. 10). The container lid member 62 includes a main body wall portion 66 and two peripheral wall portions 67 and 68. The main body wall portion 66 is a flat plate-shaped portion forming the fifth wall portion 25 of the container body 11, and has a substantially rectangular shape.

The first peripheral wall portion 67 is provided at the upper end and the lower end of the main body wall portion 66, and forms an edge portion protruding in the +X direction in an eaves shape (refer to FIG. 10). In FIG. 10, the peripheral wall portion 67 provided at the lower end of the main body wall portion 66 is hidden and cannot be seen. The peripheral wall portion 67 extends in the insertion direction (−Y direction). When the container lid member 62 is attached to the opening housing member 60, the peripheral wall portion 67 is arranged on the outer wall surface of the opening housing member 60 and forms a portion of the third wall portion 23 and the fourth wall portion 24 of the container body 11 (refer to FIGS. 5 and 7). The peripheral wall portion 67 functions as a positioning portion for positioning the container lid member 62 with respect to the opening housing member 60 (details will be described later).

The second peripheral wall portion 68 is provided at the end portion of the main body wall portion 66 on the +Y direction side, and forms the edge portion protruding in the +X direction in an eaves shape (refer to FIG. 2). The lower end portion of the peripheral wall portion 68 on the −Z direction side is connected to the end portion of the first peripheral wall portion 67 provided on the lower end side of the main body wall portion 66 on the +Y direction side. When the container lid member 62 is attached to the opening housing member 60, the peripheral wall portion 68 is arranged on the outer wall surface of the opening housing member 60, and forms a portion of the second wall portion 22 of the container body 11. An upper end portion 68*e* of the peripheral wall portion 68 on the +Z direction side is located on the −Z direction side with respect to the upper end of the second wall portion 22. The reason for this will be described later.

The main body wall portion 66 of the container lid member 62 includes an outer peripheral end portion 66*e* which is an end portion extending linearly in the Y direction on the +Y direction side of the peripheral wall portion 67 provided at the upper end of the main body wall portion 66 (refer to FIG. 10). When the container lid member 62 is attached to the opening housing member 60, the outer peripheral end portion 66*e* is arranged along a liquid receiving portion 80 (described later) provided around the liquid inlet 35 (refer to FIG. 2). Further, the outer peripheral end portion 66*e* is arranged along the lid member 85 in a state in which the liquid inlet 35 is closed (refer to FIG. 3). The peripheral wall portion 67 provided at the lower end of the container lid member 62 includes an end portion 67*e* arranged along the handle portion 40 on the +Y direction side (refer to FIG. 7). The functions of the outer peripheral end portion 66*e* and the end portion 67*e* will be described later.

As described above, in the liquid storage container 10A, the container lid member 62 is attached to the opening housing member 60 so as to close the opening of the storage chamber recess 61*a* (refer to FIG. 10). Further, the main body wall portion 66 of the container lid member 62 intersects the upper wall surface 23*s* and forms a side wall surface which is an outer wall surface of the container body 11 in the insertion direction, that is, an outer wall surface of the fifth wall portion 25 (refer to FIGS. 3 and 4). In the liquid storage container 10A, the film member 63 is protected by the container lid member 62 (refer to FIG. 10).

Further, in the liquid storage container 10A, the peripheral wall portions 67 and 68 of the container lid member 62 are arranged so as to be overlapped on the wall portion forming the third wall portion 23, the wall portion forming the fourth wall portion 24, and the wall portion forming the second wall portion 22 of the opening housing member 60 (refer to FIGS. 5, 7, and 8). As a result, in the liquid storage container 10A, generation of a large gap between the opening housing member 60 exposed to the outside and the container lid member 62 is suppressed.

A2-3. Liquid Flow Path Coupling Storage Chamber and Liquid Outlet

A2-3-1. Configuration of Flow Path

Figure 13:
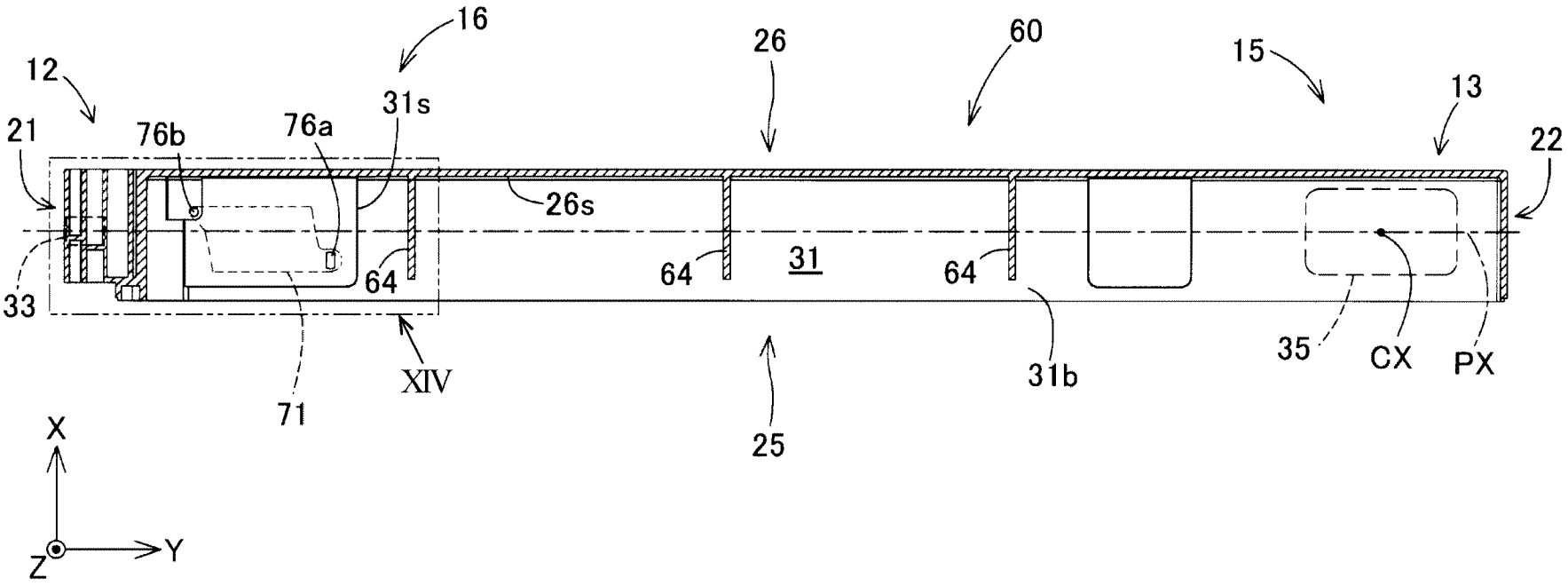
FIG. 13 is a schematic cross-sectional view of the opening housing member showing a bottom surface of a storage chamber.
Figure 14:
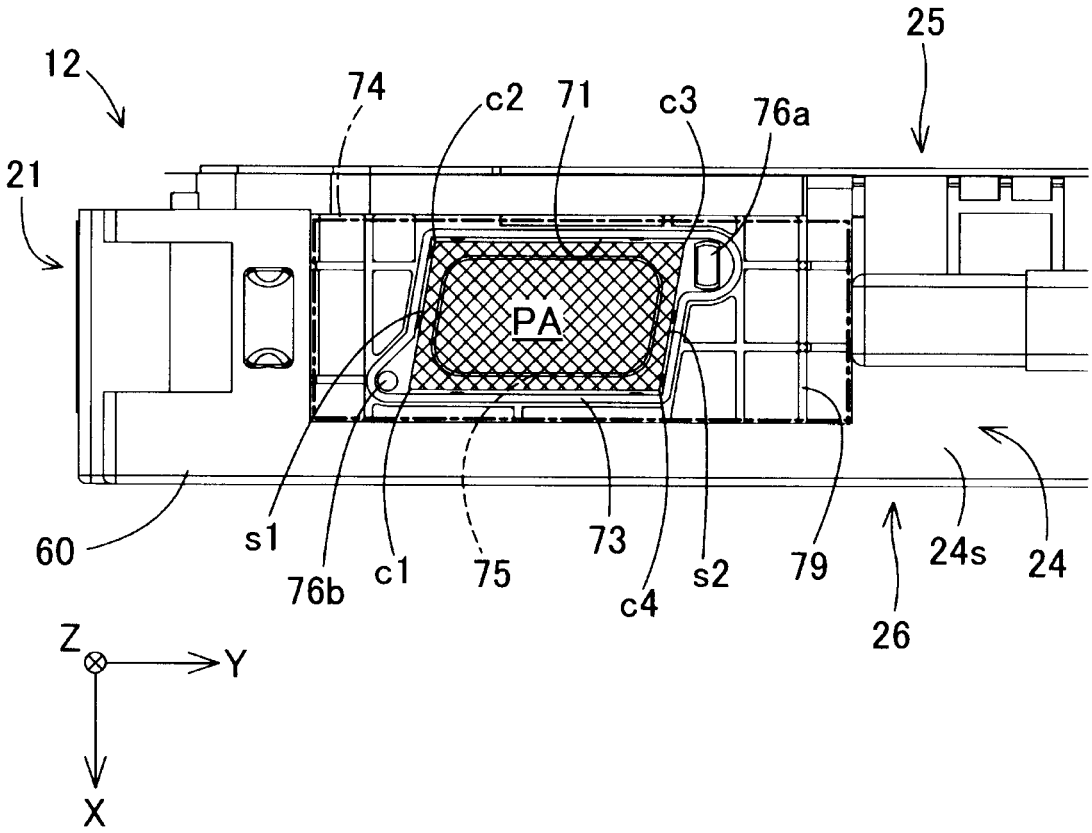
FIG. 14 is a schematic bottom view of the opening housing member.
Figure 15:
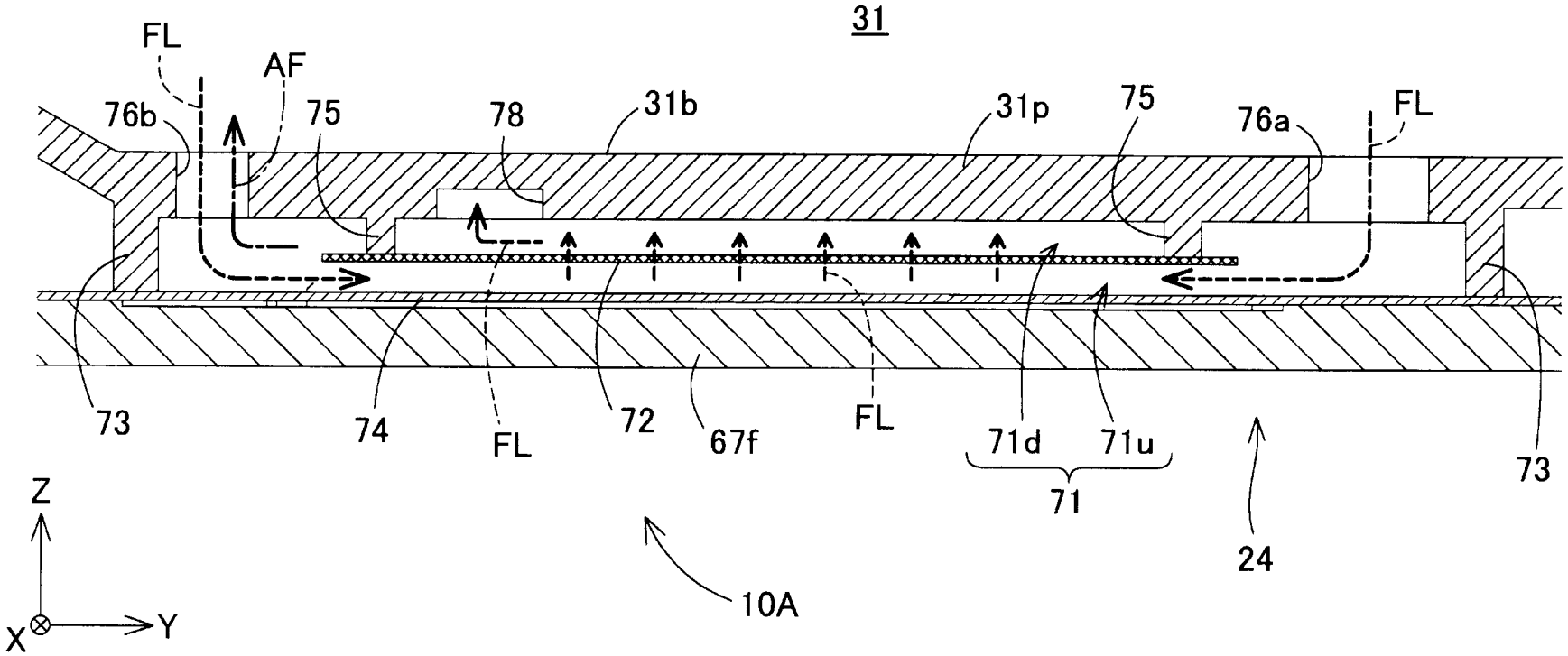
FIG. 15 is a schematic cross-sectional view of a filter chamber.
Figure 16:
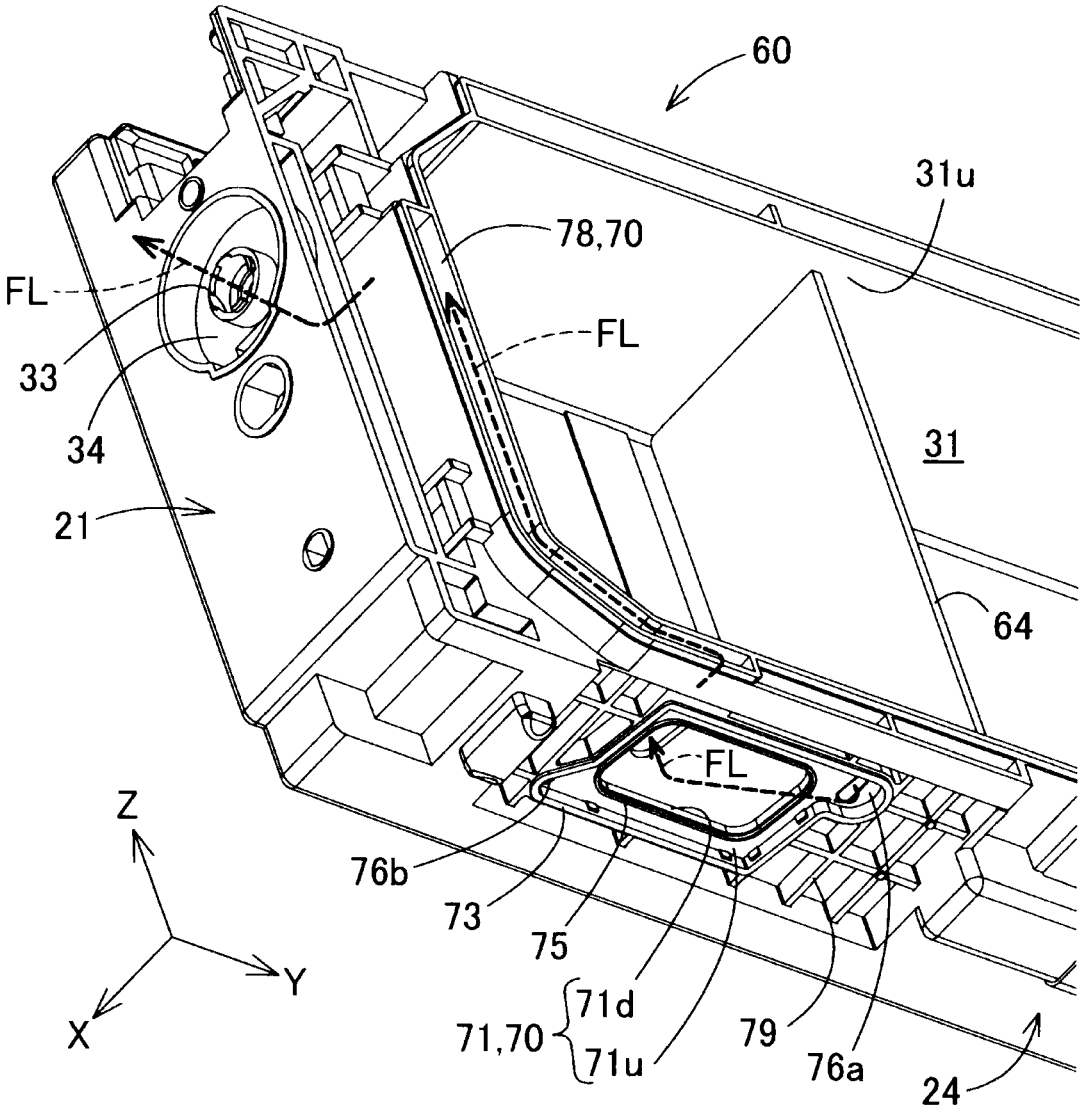
FIG. 16 is a schematic perspective view of an end portion of the opening housing member when viewed from below.

With reference to FIGS. 13 to 16, a configuration of a liquid flow path 70 coupling the storage chamber 31 and the liquid outlet 33 in the liquid storage container 10A will be described. FIG. 13 is a schematic cross-sectional view of the opening housing member 60 in XIII-XIII cutting shown in FIG. 11. FIG. 13 shows the bottom surface 31*b* of the storage chamber 31 as viewed in the −Z direction. In FIG. 13, the positions of the liquid outlet 33 and the liquid inlet 35 when the liquid storage container 10A is viewed in the −Z direction are indicated by broken lines. FIG. 14 is a schematic bottom view of the portion of the opening housing member 60 included in the region XIV shown in FIG. 13 when viewed in the +Z direction. FIG. 14 shows the filter chamber 71 provided in the fourth wall portion 24. FIG. 15 is a schematic cross-sectional view schematically showing the cross-sectional structure of the filter chamber 71 on the cut surface in the Y direction. FIG. 16 is a schematic perspective view of the end portion of the opening housing member 60 provided with the filter chamber 71 on the first wall portion 21 side when viewed from below.

In FIG. 16, arrows FL indicating a flow of liquid from the storage chamber 31 to the liquid outlet 33 are shown. The container body 11 of the liquid storage container 10A is provided with the liquid flow path 70 coupling the storage chamber 31 and the liquid outlet 33 (refer to FIG. 16). The flow path 70 includes the filter chamber 71 and the outlet flow path 78.

The filter chamber 71 is a space for accommodating a filter 72 that captures foreign substances and air bubbles contained in the liquid and removes them from the liquid (refer to FIGS. 14 and 15). The filter 72 is provided between the storage chamber 31 and the liquid outlet 33. The filter chamber 71 receives the liquid from the storage chamber 31 to filter the liquid by the filter 72. In the present specification, not only substances not contained in the liquid component but also particles in which fine particles dispersed as the liquid component are aggregated and have a specified size or larger are included in the foreign substances in the liquid captured and removed by the filter 72.

The filter chamber 71 is provided below the storage chamber 31 (refer to FIGS. 14 and 16). The storage chamber 31 and the filter chamber 71 are separated by a partition wall 31*p* (refer to FIG. 15). The filter chamber 71 is provided inside the fourth wall portion 24 of the container body 11 (refer to FIGS. 7 and 13). In FIGS. 7 and 13, since the filter chamber 71 is hidden and cannot be seen, its position is indicated by a broken line. When the liquid storage container 10A is viewed in the Z direction, the filter chamber 71 is aligned with the liquid inlet 35 in the insertion direction, in other words, in the Y direction (refer to the left and right parts of FIG. 13). The filter chamber 71 is formed as a recessed space surrounded by a rib 73 protruding in the −Z direction on the surface of the wall portion of the opening housing member 60 forming the fourth wall portion 24 of the container body 11 on the −Z direction side. (refer to FIGS. 14 and 16).

After the filter 72 is arranged in the recessed space, a film member 74 is welded to the rib 73. As a result, the opening of the recessed space forming the filter chamber 71 is sealed by the film member 74 (refer to FIGS. 10 and 15). In FIG. 14, the arrangement region of the film member 74 is indicated by a one-dot chain line. When the container lid member 62 is attached to the opening housing member 60, a filter chamber wall portion 67*f* of the container lid member 62 covers the film member 74 (refer to FIGS. 4 and 7). The filter chamber wall portion 67*f* is a portion of the peripheral wall portion 67. The peripheral wall portion 67 is provided at the end portion of the container lid member 62 on the −Z direction side. The filter chamber wall portion 67*f* is arranged so as to abut the end portion of a second rail portion 42 on the −Y direction side (refer to FIG. 7).

The filter 72 is made of a film-like member having pores. The filter 72 allows the liquid to pass through the pores in the thickness direction, and removes foreign substances and air bubbles contained in the liquid having a size larger than the diameter of the pores from the liquid (refer to FIG. 15). The filter 72 is joined to and supported by a filter support wall 75 so that the thickness direction coincides with the Z direction. The filter support wall 75 is a protrusion protruding in the −Z direction from the upper surface of the filter chamber 71. The outer peripheral shape of the region surrounded by the filter support wall 75 is a shape that follows the outer peripheral shape of the filter 72.

In the liquid storage container 10A, the outer peripheral shape of the filter 72, that is, the shape when the filter 72 is viewed in the thickness direction is substantially a quadrangle (refer to FIG. 14). In the first embodiment, the outer peripheral shape of the filter 72 is substantially a parallelogram. The filter 72 has a first side s1 located on the insertion direction side, that is, the −Y direction side, and a second side s2 located on the side opposite to the insertion direction, that is, on the Y direction side with respect to the first side s1. The filter 72 has a first pair of corner portions c1 and c2 at both ends of the first side s1 and a second pair of corner portions c3 and c4 at both ends of the second side s2. One corner portion c1 of the first pair of corner portions c1 and c2 is located at a position protruding from the other corner portion c2 in the insertion direction, that is, on the −Y direction side. One corner portion c3 of the second pair of corner portions c3 and c4 is located at a position protruding from the other corner portion c4 on the side opposite to the insertion direction, that is, on the Y direction side.

The filter chamber 71 is partitioned by the filter 72 into an upstream space 71*u* located upstream of the filter 72 and a downstream space 71*d* located downstream of the filter 72 (refer to FIG. 15). The upstream space 71*u* is coupled to the storage chamber 31 through a first communication port 76*a* and a second communication port 76*b*. The downstream space 71*d* is a space surrounded by the filter support wall 75 and is coupled to the outlet flow path 78 (refer to FIGS. 15 and 16). The upstream space 71*u* is located below the filter 72 and the downstream space 71*d*.

The first communication port 76*a* and the second communication port 76*b* communicating with the upstream space 71*u* are open at the bottom surface 31*b* of the storage chamber 31 (refer to FIGS. 13, 14, and 16). The first communication port 76*a* is provided at a position closer to the liquid inlet 35 than the filter chamber 71 in the insertion direction, that is, the −Y direction (refer to FIG. 13). The first communication port 76*a* is provided at a position closer to the fifth wall portion 25 than the sixth wall portion 26 in the X direction (refer to FIG. 13). The first communication port 76*a* is provided at a position closer to the third corner portion c3 than the fourth corner portion c4 of the filter 72 (refer to FIG. 14).

The second communication port 76*b* is provided on the side opposite to the first communication port 76*a* with the filter 72 interposed therebetween in the insertion direction, that is, in the −Y direction. The second communication port 76*b* is provided at a position closer to the liquid outlet 33 than the filter chamber 71. The second communication port 76*b* is provided at a position closer to the sixth wall portion 26 than the fifth wall portion 25 in the X direction. The second communication port 76*b* is provided at a position closer to the first corner portion c1 than the second corner portion c2 of the filter 72.

As described above, the first communication port 76*a* is provided at a position closer to the fifth wall portion 25 than the sixth wall portion 26 in the X direction (refer to FIG. 13). Therefore, the liquid that has passed between the reinforcing wall portion 64 and the film member 63 easily flows into the filter chamber 71 through the first communication port 76*a*. Further, the first communication port 76*a* and the second communication port 76*b* are open on the surface of the bottom surface 31*b* that is slightly higher than the surroundings via a step 31*s* (refer to FIG. 13). Therefore, it is suppressed that the foreign substance settling on the lower surface of the bottom surface 31*b* gets over the step 31*s* and flows into the first communication port 76*a* and the second communication port 76*b*.

The rib 73 surrounding the filter chamber 71 is formed so as to surround the filter 72, the first communication port 76*a*, and the second communication port 76*b* along their outer peripheral contour lines (refer to FIG. 14). On the outside of the filter chamber 71, a reinforcing rib 79 for increasing the strength around the filter chamber 71 is formed in a grid pattern. As a result, deformation of the wall portion around the filter chamber 71 is suppressed, and peeling of the filter 72 and the film member 74 is suppressed.

A2-3-2. Configuration of First Communication Port

Figure 17:
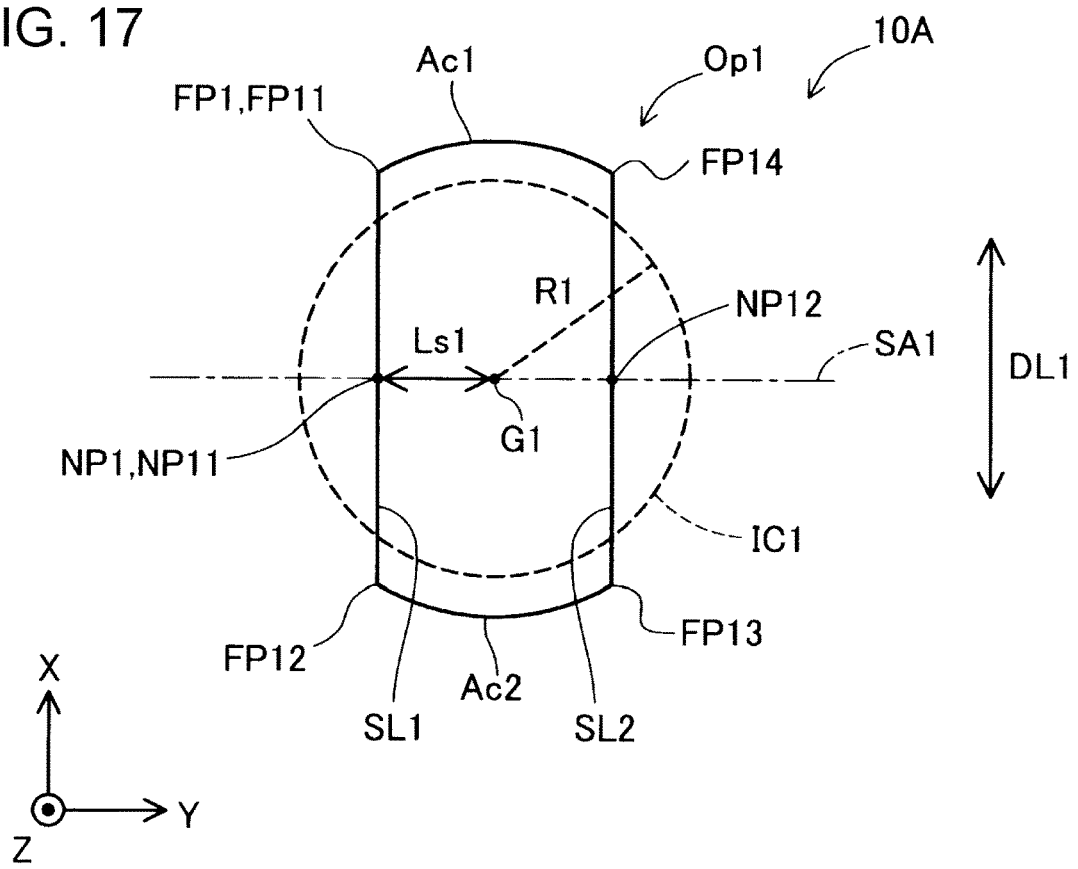
FIG. 17 is a plan view of a first communication port when viewed from inside the storage chamber in a −Z direction.

FIG. 17 is a plan view of the first communication port 76*a* when viewed from inside the storage chamber 31 in the −Z direction. The partition wall 31*p* that separates the storage chamber 31 and the filter chamber 71 is provided with the first communication port 76*a* (refer to FIG. 15). The first communication port 76*a* communicates the storage chamber 31 and the filter chamber 71. The first communication port 76*a* has one opening Op1 in the storage chamber 31 (refer to FIG. 17).

The shape of the opening Op1 of the first communication port 76*a* in the storage chamber 31 is defined by a pair of line segments SL1 and SL2 having the same length arranged in parallel and a pair of arcs Ac1 and Ac2 connecting two sets of ends of the pair of line segments SL1 and SL2, respectively. The arcs Ac1 and Ac2 are a portion of the circumference of the same circle. The shape of the opening Op1 is a shape in which the X direction is a longitudinal direction DL1 and the Y direction is a lateral direction.

With such a configuration, a mold for producing the partition wall 31*p* provided with the first communication port 76*a* can be easily constructed. By removing both sides of a round bar having a circular cross section across the central axis from the ends toward the central axis by a certain dimension, it is possible to produce a bar having the same cross-sectional shape as the shape of the opening Op1. By using such a bar as a portion for generating the opening Op1 in the mold for producing the partition wall 31*p*, the opening Op1 can be easily provided.

In the present embodiment, the shape of the opening Op1 of the first communication port 76*a* in the storage chamber 31 is a shape in which a distance Ls1 from the center of gravity G1 of the entirety of the opening Op1 to the closest points NP11 and NP12 in the contour defining the opening Op1 is smaller than a radius R1 of an imaginary circle IC1 having the same area as the area of the entirety of the opening Op1. When the points NP11 and NP12 are described without distinction, they are described as a point NP1.

When the ink in the storage chamber 31 is consumed and a liquid level LL approaches the bottom surface 31*b* of the storage chamber 31, that is, the partition wall 31*p* in a state in which the posture of the liquid storage container 10A is tilted so that the +Y end of both ends in the Y direction is lower than the −Y end, the following situations may occur, that is, air may enter the filter chamber 71 together with the ink from the opening Op1 (refer to LL and 71 in FIG. 11). However, according to the present embodiment, compared with the mode in which the shape of the opening in the storage chamber 31 is the imaginary circle IC1 having the same opening area as the opening area of the opening Op1, even when the liquid level of the liquid in the storage chamber 31 approaches the partition wall 31*p*, a portion through which air flows is unlikely to be formed in the center of the opening Op1. Therefore, the possibility that the liquid containing air bubbles is supplied to the liquid consumption device 500 can be reduced. A more specific description will be given below.

In the present embodiment, the shape of the opening Op1 in the storage chamber 31 of the first communication port 76*a* includes proximity portions NP11 and NP12 where a distance to the center of gravity G1 of the opening Op1 is smaller than the radius R1 of the imaginary circle IC1 and remote portions FP11, FP12, FP13, and FP14 where a distance to the center of gravity G1 is larger than the radius R1 of the imaginary circle IC1. When the points FP11, FP12, FP13, and FP14 are described without distinction, they are described as a point FP1.

As a result, since the distance between the inks flowing along the proximity portions NP11 and NP12 is short, a portion through which air flows is unlikely to be formed in the center of the ink flowing through the opening Op1. On the other hand, since the opening Op1 has the remote portions FP11, FP12, FP13, and FP14, the area of the opening Op1 can be increased as compared with the mode in which the shape of the opening is a circle having a radius Ls1. As a result, a large amount of ink can be made to flow from the storage chamber 31 toward the filter chamber 71 through the first communication port 76*a* per unit time.

The longitudinal direction DL1 of the shape of the opening Op1 is perpendicular to the longitudinal direction Y of the liquid storage container 10A (refer to FIGS. 17 and 13). The longitudinal direction DL1 is also perpendicular to the Z direction. The ink in the storage chamber 31 tends to be biased to any end of the liquid storage container 10A in the longitudinal direction Y due to the tilt of the liquid storage container 10A. However, with such a configuration, it is possible to prevent the formation of a portion through which air flows in the center of the opening Op1 regardless of the direction of the tilt of the liquid storage container 10A.

The shape of the opening Op1 is symmetrical with respect to a straight line SA1 parallel to the longitudinal direction Y of the liquid storage container 10A. With such a configuration, the bias of the flowing liquid is reduced on both sides of the straight line SA1 of the opening Op1. Therefore, it is possible to prevent the formation of a portion through which air flows in the center of the opening Op1.

A2-3-3. Liquid Flow in Flow Path

The flow of the liquid in the flow path 70 will be described with reference to FIGS. 15 and 16. The liquid in the storage chamber 31 flows into the upstream space 71*u* of the filter chamber 71 through the first communication port 76*a* and the second communication port 76*b* (refer to arrows FL in FIG. 15). The liquid flows inside the filter 72 in the direction opposite to the direction of gravity and flows into the downstream space 71*d*. At this time, foreign substances and air bubbles mixed in the liquid remain in the upstream space 71*u*. The liquid that has flowed into the downstream space 71*d* flows into the outlet flow path 78 coupled to the downstream space 71*d*, and flows through the outlet flow path 78 to the liquid outlet 33 (refer to the arrows FL in FIG. 16).

FIG. 13 will be referred to. In the liquid storage container 10A, the filter 72 is provided at a position closer to the liquid outlet 33 than the liquid inlet 35 in the insertion direction. As a result, foreign substances mixed in the liquid poured through the liquid inlet 35 can be settled before reaching the filter 72. Accordingly, the foreign substances are suppressed from reaching the filter 72, and the clogging of the filter 72 due to the foreign substances is suppressed. Further, by pouring the liquid from the liquid inlet 35, even if air bubbles are mixed in the liquid in the storage chamber 31, the amount of air bubbles reaching the filter 72 can be reduced. Since the distance between the liquid outlet 33 and the filter 72 is short, increase in pressure loss between the filter 72 and the liquid outlet 33 is suppressed. Accordingly, it is possible to reduce the suction force for sucking the liquid generated by the suction pump of the liquid consumption device 500 to the liquid outlet 33.

In the liquid storage container 10A, the filter chamber 71 is provided below the storage chamber 31 (refer to FIG. 15). Therefore, the liquid can be guided from the storage chamber 31 to the filter chamber 71 by gravity, and the inflow of the liquid into the filter chamber 71 is smoothed. Accordingly, the flow of the liquid from the liquid storage container 10A to the liquid consumption device 500 can be made smoother, and the liquid supply performance of the liquid storage container 10A to the liquid consumption device 500 is enhanced.

In the liquid storage container 10A, the upstream space 71*u* of the filter chamber 71 is located below the filter 72 and the downstream space 71*d*, and the liquid in the filter chamber 71 passes through the filter 72 in the direction opposite to the direction of gravity. Therefore, the foreign substances removed from the liquid by the filter 72 can be settled below the filter 72 by gravity. Therefore, the occurrence of clogging of the filter 72 is further suppressed.

In the liquid storage container 10A, the storage chamber 31 and the filter chamber 71 communicate with the first communication port 76*a* provided near the liquid inlet 35 and the second communication port 76*b* provided far from the liquid inlet 35, which is located on the −Y direction side of the first communication port 76*a*. As a result, when the liquid is poured into the empty storage chamber 31, the air in the upstream space 71*u* can escape from the second communication port 76*b* to the storage chamber 31 while flowing the liquid from the first communication port 76*a* into the upstream space 71*u* of the filter chamber 71 (refer to an arrow AF in FIG. 15). Accordingly, retention of air in the upstream space 71*u* of the filter chamber 71 is suppressed, and it is suppressed that the replenishment of the liquid into the filter chamber 71 is hindered due to such retention of air, and the liquid supply performance to the liquid consumption device 500 deteriorates.

In the liquid storage container 10A, the first corner portion c1 of the filter 72 is located at a position protruding toward the insertion direction side with respect to the second corner portion c2 and the third corner portion c3 is located at a position protruding toward the side opposite to the insertion direction with respect to the fourth corner portion c4 (refer to FIG. 14). That is, the first corner portion c1 is located on the −Y direction side of the second corner portion c2, and the third corner portion c3 is located on the +Y direction side of the fourth corner portion c4. The outer peripheral shape of a liquid passage region PA in the filter 72 surrounded by the filter support wall 75 is also shaped to follow the outer peripheral shape of the filter 72. As a result, compared with the case where the outer peripheral shape of the filter 72 is a rectangular shape having corner portions at the positions of the second corner portion c2 and the fourth corner portion c4 and the outer peripheral shape of the liquid passage region PA is matched to the rectangular shape, the area of the liquid passage region PA in the filter 72 is increased under the condition that the width dimension in the X direction is limited. Accordingly, the effect of removing foreign substances by the filter 72 is enhanced by that amount. Further, the outer peripheral shapes of the filters 72 do not match when the front and back surfaces thereof are reversed. Therefore, it is easy to distinguish the upper surface and the lower surface of the filter 72. Accordingly, the process of assembling the filter 72 to the container body 11 of the liquid storage container 10A is simplified.

In the liquid storage container 10A, the filter chamber 71 is exposed to the outside by removing the container lid member 62 from the opening housing member 60 (refer to FIGS. 7 and 16). Therefore, the filter 72 can be easily replaced and maintained.

The first communication port 76*a* in the present embodiment is also referred to as a "communication hole structure".

B. Second Embodiment

In a liquid storage container 10B according to a second embodiment, the cross-sectional shape of the flow path of a first communication port 76*a* is different from that of the liquid storage container 10A according to the first embodiment. Other points are the same as the liquid storage container 10A according to the first embodiment.

Figure 18:
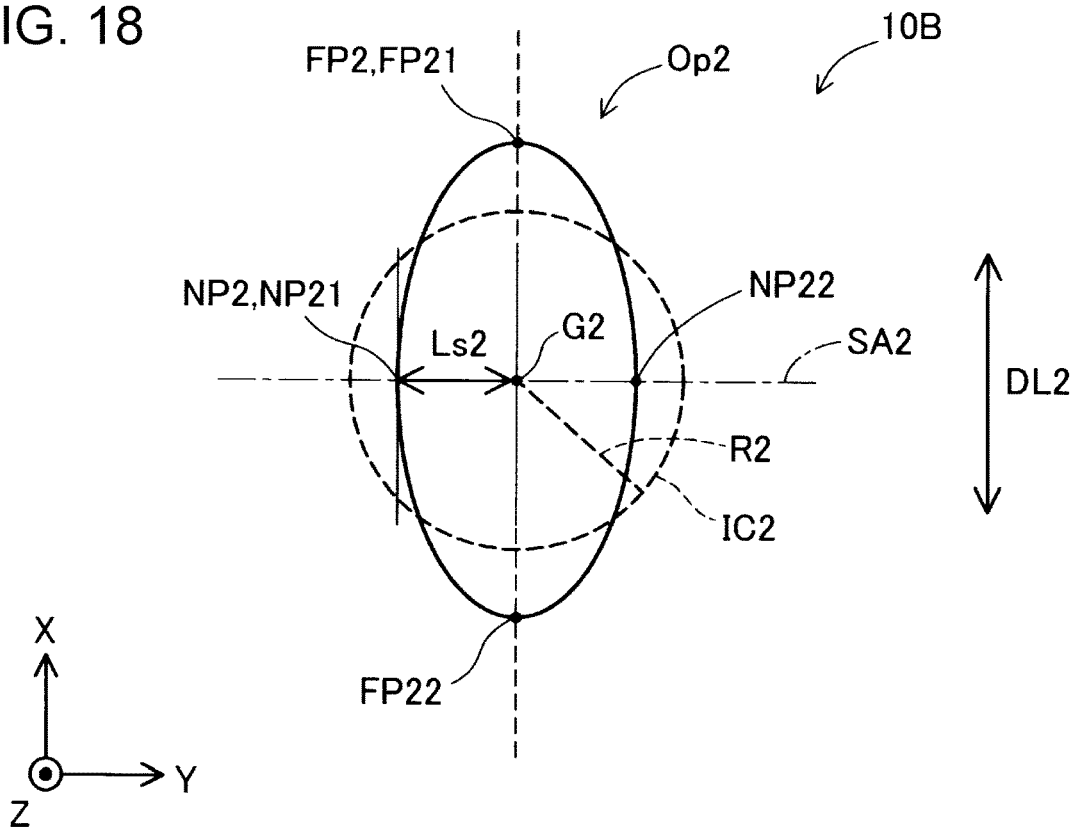
FIG. 18 is a plan view of a first communication port when viewed from inside a storage chamber in the −Z direction in a liquid storage container according to a second embodiment.

FIG. 18 is a plan view of a first communication port 76*a* when viewed from inside a storage chamber 31 in the −Z direction in a liquid storage container 10B according to a second embodiment. In the second embodiment, the first communication port 76*a* is provided with one opening Op2 in the storage chamber 31.

The shape of the opening Op2 of the first communication port 76*a* in the storage chamber 31 is elliptical. The shape of the opening Op2 is a shape in which the X direction is a longitudinal direction DL2 and the Y direction is a lateral direction.

In the present embodiment, the shape of the opening Op2 of the first communication port 76*a* in the storage chamber 31 is a shape in which a distance Ls2 from the center of gravity G2 of the entirety of the opening Op2 to the closest points NP21 and NP22 in the contour defining the opening Op2 is smaller than a radius R2 of an imaginary circle IC2 having the same area as the area of the entirety of the opening Op2. When the points NP21 and NP22 are described without distinction, they are described as a point NP2.

Also in the present embodiment, compared with the mode in which the shape of the opening in the storage chamber 31 is the imaginary circle IC2 having the same opening area as the opening area of the opening Op2, even when the liquid level of the liquid in the storage chamber 31 approaches the partition wall 31*p*, a portion through which air flows is unlikely to be formed in the center of the opening Op2. Therefore, the possibility that the liquid containing air bubbles is supplied to the liquid consumption device 500 can be reduced. A more specific description will be given below.

In the present embodiment, the shape of the opening Op2 includes proximity portions NP21 and NP22 where a distance to the center of gravity G2 of the opening Op2 is smaller than the radius R2 of the imaginary circle IC2 and remote portions FP21 and FP22 where a distance to the center of gravity G2 is larger than the radius R2 of the imaginary circle IC2. When the points FP21 and FP22 are described without distinction, they are described as a point FP2.

As a result, since the distance between the inks flowing along the proximity portions NP21 and NP22 is short, a portion through which air flows is unlikely to be formed in the center of the ink flowing through the opening Op2. On the other hand, since the opening Op2 has the remote portions FP21 and FP22, the area of the opening Op2 can be increased as compared with the mode in which the shape of the opening is a circle having a radius Ls2. As a result, a large amount of ink can be made to flow from the storage chamber 31 toward the filter chamber 71 through the first communication port 76*a* per unit time.

The longitudinal direction DL2 of the shape of the opening Op2 is perpendicular to the longitudinal direction Y of the liquid storage container 10B. The ink in the storage chamber 31 tends to be biased to any end of the liquid storage container 10B in the longitudinal direction Y due to the tilt of the liquid storage container 10B. However, with such a configuration, it is possible to prevent the formation of a portion through which air flows in the center of the opening Op2 regardless of the direction of the tilt of the liquid storage container 10B.

The shape of the opening Op2 is symmetrical with respect to a straight line SA2 parallel to the longitudinal direction Y of the liquid storage container 10B. With such a configuration, the bias of the flowing liquid is reduced on both sides of the straight line SA2 of the opening Op2. Therefore, it is possible to prevent the formation of a portion through which air flows in the center of the opening Op2.

C. Third Embodiment

In a liquid storage container 10C according to a third embodiment, the cross-sectional shape of the flow path of a first communication port 76*a* is different from that of the liquid storage container 10A according to the first embodiment. Other points are the same as the liquid storage container 10A according to the first embodiment.

Figure 19:
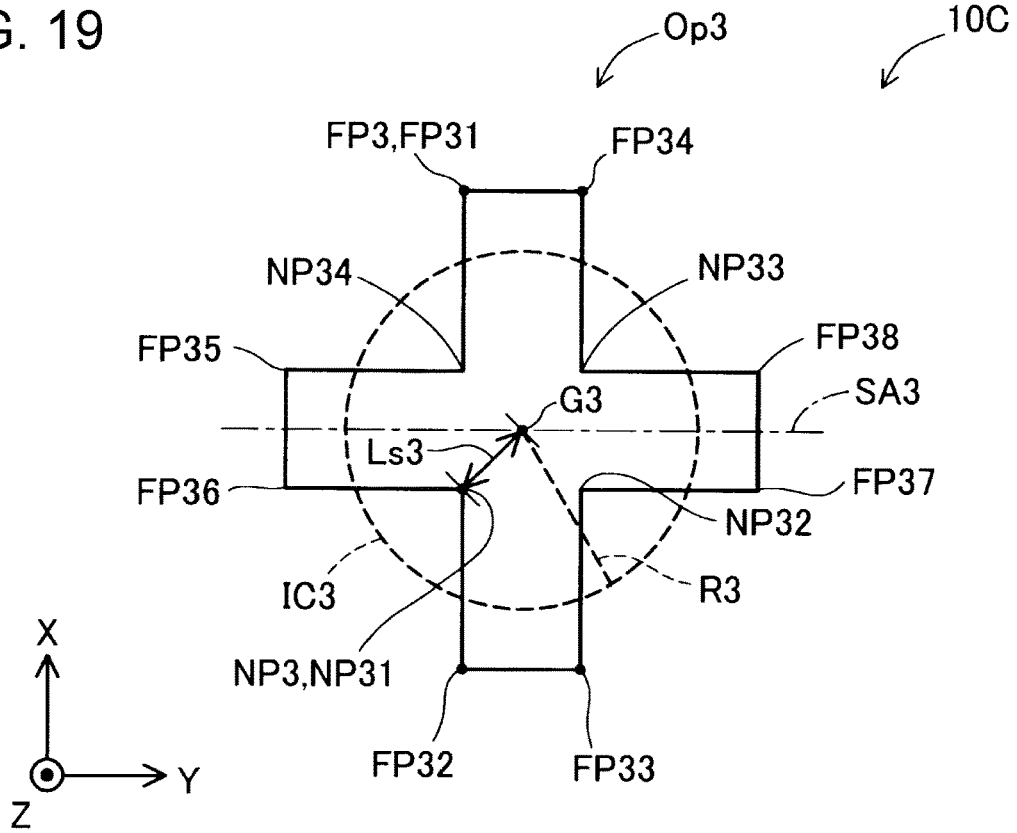
FIG. 19 is a plan view of a first communication port when viewed from inside a storage chamber in the −Z direction in a liquid storage container according to a third embodiment.

FIG. 19 is a plan view of a first communication port 76*a* when viewed from inside a storage chamber 31 in the −Z direction in a liquid storage container 10C according to a third embodiment. In the third embodiment, the first communication port 76*a* is provided with one opening Op3 in the storage chamber 31.

The shape of the opening Op3 of the first communication port 76*a* in the storage chamber 31 is a so-called cross shape in which rectangles of the same shape are overlapped at relative positions where the centers of gravity of each are aligned and their longitudinal directions are perpendicular to each other. The shape of the opening Op3 is a shape in which the vertices of each rectangle are inscribed in the same circle. As a result, the shape of the opening Op3 has neither the longitudinal direction nor the lateral direction.

In the present embodiment, the shape of the opening Op3 of the first communication port 76*a* in the storage chamber 31 is a shape in which a distance Ls3 from the center of gravity G3 of the entirety of the opening Op3 to the closest points NP31, NP32, NP33, and NP34 in the contour defining the opening Op3 is smaller than a radius R3 of an imaginary circle IC3 having the same area as the area of the entirety of the opening Op3. When the points NP31, NP32, NP33, and NP34 are described without distinction, they are described as a point NP3.

Also in the present embodiment, compared with the mode in which the shape of the opening in the storage chamber 31 is the imaginary circle IC3 having the same opening area as the opening area of the opening Op3, even when the liquid level of the liquid in the storage chamber 31 approaches the partition wall 31*p*, a portion through which air flows is unlikely to be formed in the center of the opening Op3. Therefore, the possibility that the liquid containing air bubbles is supplied to the liquid consumption device 500 can be reduced. A more specific description will be given below.

In the present embodiment, the shape of the opening Op3 includes proximity portions NP31, NP32, NP33, and NP34 where a distance to the center of gravity G3 of the opening Op3 is smaller than the radius R3 of the imaginary circle IC3 and remote portions FP31, FP32, FP33, FP34, FP35, FP36, FP37, and FP38 where a distance to the center of gravity G3 is larger than the radius R3 of the imaginary circle IC3. When the points FP31 to FP38 are described without distinction, they are described as a point FP3.

As a result, since the distance between the inks flowing along the proximity portions NP31, NP32, NP33, and NP34 is short, a portion through which air flows is unlikely to be formed in the center of the ink flowing through the opening Op3. On the other hand, since the opening Op3 has the remote portions FP31 to FP38, the area of the opening Op3 can be increased as compared with the mode in which the shape of the opening is a circle having a radius Ls3. As a result, a large amount of ink can be made to flow from the storage chamber 31 toward the filter chamber 71 through the first communication port 76*a* per unit time.

The shape of the opening Op3 is symmetrical with respect to a straight line SA3 parallel to the longitudinal direction Y of the liquid storage container 10C. With such a configuration, the bias of the flowing liquid is reduced on both sides of the straight line SA3 of the opening Op3. Therefore, it is possible to prevent the formation of a portion through which air flows in the center of the opening Op3.

D. Fourth Embodiment

In a liquid storage container 10D according to a fourth embodiment, the cross-sectional shape of the flow path of a first communication port 76*a* is different from that of the liquid storage container 10A according to the first embodiment. Other points are the same as the liquid storage container 10A according to the first embodiment.

Figure 20:
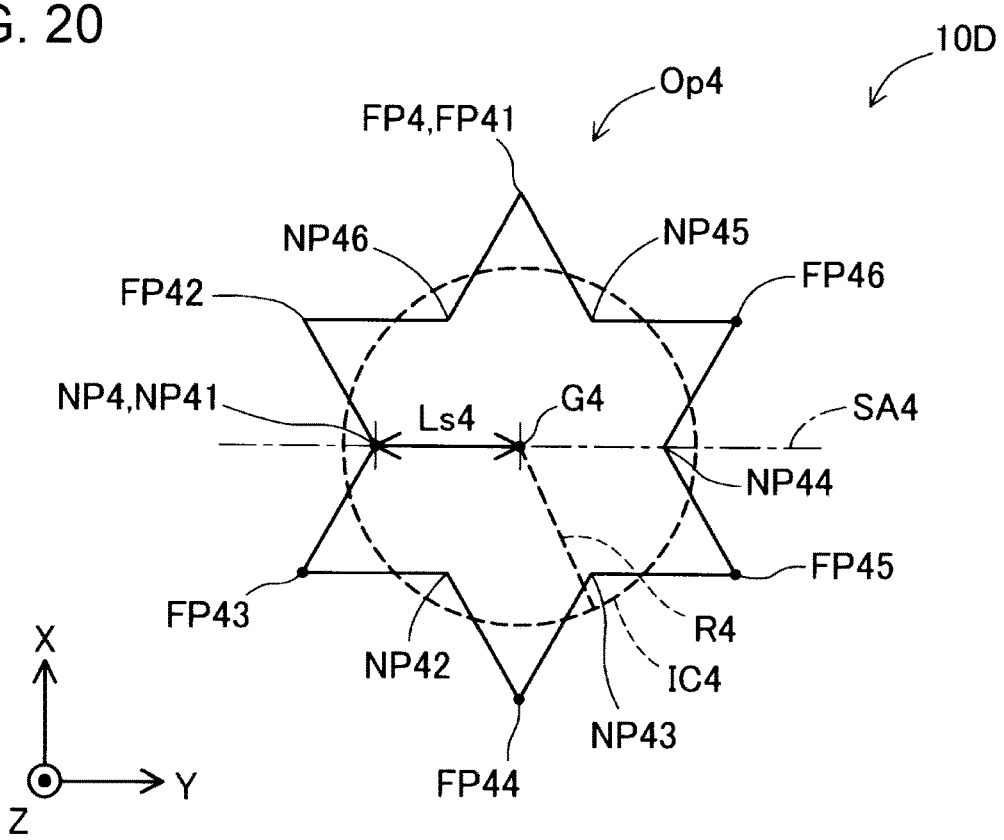
FIG. 20 is a plan view of a first communication port when viewed from inside a storage chamber in the −Z direction in a liquid storage container according to a fourth embodiment.

FIG. 20 is a plan view of a first communication port 76*a* when viewed from inside a storage chamber 31 in the −Z direction in a liquid storage container 10D according to a fourth embodiment. In the fourth embodiment, the first communication port 76*a* is provided with one opening Op4 in the storage chamber 31.

The shape of the opening Op4 of the first communication port 76*a* in the storage chamber 31 is a so-called hexagram shape in which equilateral triangles of the same shape are overlapped at relative positions where the centers of gravity of each are aligned and the vertices are arranged at intervals of 60° around the center of gravity. The shape of the opening Op4 is a shape in which each vertex is inscribed in the same circle. As a result, the shape of the opening Op4 has neither the longitudinal direction nor the lateral direction.

In the present embodiment, the shape of the opening Op4 of the first communication port 76*a* in the storage chamber 31 is a shape in which a distance Ls4 from the center of gravity G4 of the entirety of the opening Op4 to the closest points NP41, NP42, NP43, NP44, NP45, and NP46 in the contour defining the opening Op4 is smaller than a radius R4 of an imaginary circle IC4 having the same area as the area of the entirety of the opening Op4. When the points NP41 to NP46 are described without distinction, they are described as a point NP4.

Also in the present embodiment, compared with the mode in which the shape of the opening in the storage chamber 31 is the imaginary circle IC4 having the same opening area as the opening area of the opening Op4, even when the liquid level of the liquid in the storage chamber 31 approaches the partition wall 31*p*, a portion through which air flows is unlikely to be formed in the center of the opening Op4. Therefore, the possibility that the liquid containing air bubbles is supplied to the liquid consumption device 500 can be reduced. A more specific description will be given below.

In the present embodiment, the shape of the opening Op4 includes proximity portions NP41, NP42, NP43, NP44, NP45, and NP46 where a distance to the center of gravity G4 of the opening Op4 is smaller than the radius R4 of the imaginary circle IC4 and remote portions FP41, FP42, FP43, FP44, FP45, and FP46 where a distance to the center of gravity G4 is larger than the radius R4 of the imaginary circle IC4. When the points FP41 to FP46 are described without distinction, they are described as a point FP4.

As a result, since the distance between the inks flowing along the proximity portions NP41 to NP46 is short, a portion through which air flows is unlikely to be formed in the center of the ink flowing through the opening Op4. On the other hand, since the opening Op4 has the remote portions FP41 to FP46, the area of the opening Op4 can be increased as compared with the mode in which the shape of the opening is a circle having a radius Ls4. As a result, a large amount of ink can be made to flow from the storage chamber 31 toward the filter chamber 71 through the first communication port 76*a* per unit time.

The shape of the opening Op4 is symmetrical with respect to a straight line SA4 parallel to the longitudinal direction Y of the liquid storage container 10D. With such a configuration, the bias of the flowing liquid is reduced on both sides of the straight line SA4 of the opening Op4. Therefore, it is possible to prevent the formation of a portion through which air flows in the center of the opening Op4.

E. Fifth Embodiment

In a liquid storage container 10E according to a fifth embodiment, the cross-sectional shape of the flow path of a first communication port 76*a* is different from that of the liquid storage container 10A according to the first embodiment. Other points are the same as the liquid storage container 10A according to the first embodiment.

Figure 21:
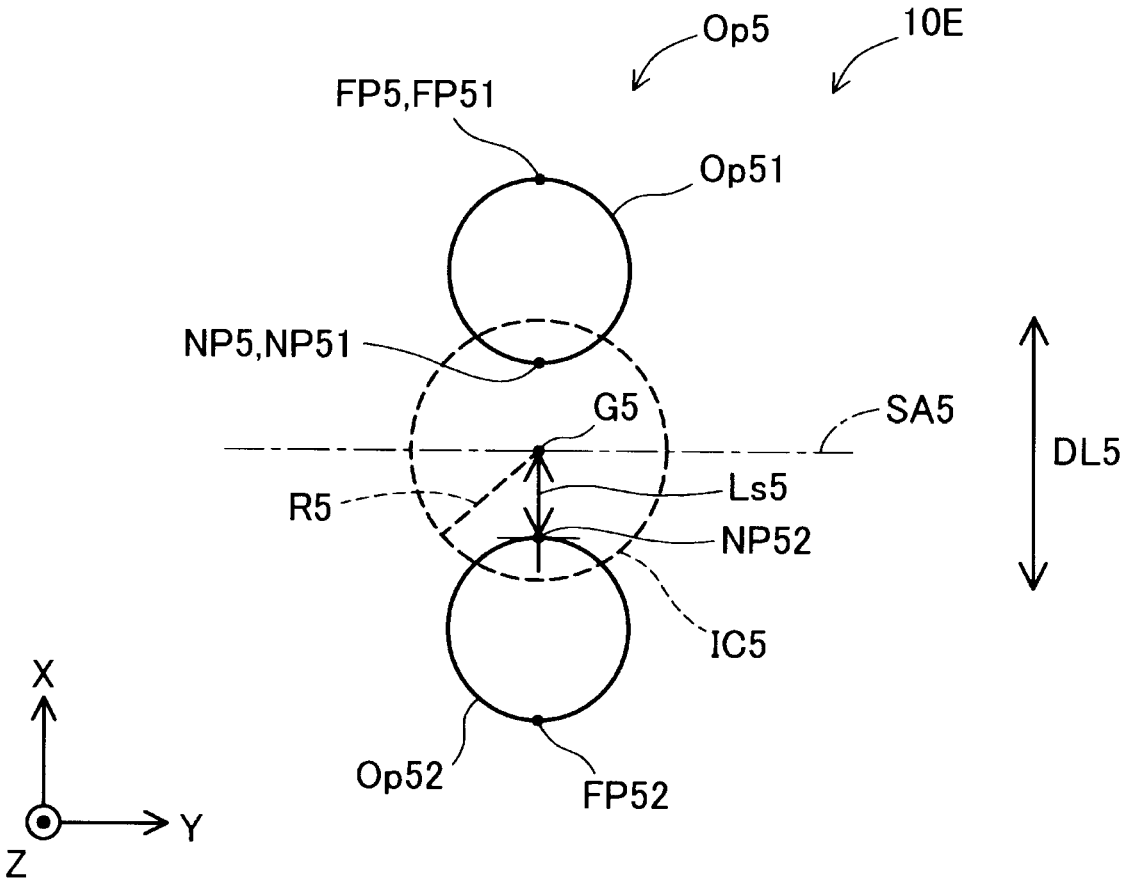
FIG. 21 is a plan view of a first communication port when viewed from inside a storage chamber in the −Z direction in a liquid storage container according to a fifth embodiment.

FIG. 21 is a plan view of a first communication port 76*a* when viewed from inside a storage chamber 31 in the −Z direction in a liquid storage container 10E according to a fifth embodiment. In the fifth embodiment, the first communication port 76*a* is provided with two openings Op51 and Op52 in the storage chamber 31. The entire opening including the two openings Op51 and Op52 is collectively described as an opening Op5.

The shapes of the openings Op51 and Op52 of the first communication port 76*a* in the storage chamber 31 are circular. The openings Op51 and Op52 are arranged side by side in the X direction in the partition wall 31*p*. As a result, the shape of the opening Op5 including the openings Op51 and Op52 is a shape in which the X direction is a longitudinal direction DL5 and the Y direction is a lateral direction.

In the present embodiment, the shape of the opening Op5 of the first communication port 76*a* in the storage chamber 31 is a shape in which a distance Ls5 from the center of gravity G5 of the entirety of the opening Op5 to the closest points NP51 and NP52 in the contour defining the opening Op5 is smaller than a radius R5 of an imaginary circle IC5 having the same area as the area of the entirety of the opening Op5. When the points NP51 and NP52 are described without distinction, they are described as a point NP5.

Also in the present embodiment, compared with the mode in which the shape of the opening in the storage chamber 31 is the imaginary circle IC5 having the same opening area as the opening area of the opening Op5, even when the liquid level of the liquid in the storage chamber 31 approaches the partition wall 31*p*, a portion through which air flows is unlikely to be formed in the center of each of the openings Op51 and Op52. Therefore, the possibility that the liquid containing air bubbles is supplied to the liquid consumption device 500 can be reduced. A more specific description will be given below.

In the present embodiment, the shape of the opening Op5 includes proximity portions NP51 and NP52 where a distance to the center of gravity G5 of the opening Op5 is smaller than the radius R5 of the imaginary circle IC5 and remote portions FP51 and FP52 where a distance to the center of gravity G5 is larger than the radius R5 of the imaginary circle IC5. That is, the region of the imaginary circle IC5 includes a portion forming the partition wall 31*p* instead of the opening. The radius of each of the openings Op51 and Op52 is naturally smaller than the radius R5 of the imaginary circle IC5 having the same area as the area of the entirety of the opening Op5. When the points FP51 and FP52 are described without distinction, they are described as a point FP5.

As a result, in the opening Op51, since the distance between the proximity portion NP51 and the remote portion FP51 located on both sides of the center of the circle is smaller than the diameter of the imaginary circle IC5, a portion through which air flows is unlikely to be formed in the center of the ink flowing through the opening Op51. In the opening Op52, since the distance between the proximity portion NP52 and the remote portion FP52 located on both sides of the center of the circle is smaller than the diameter of the imaginary circle IC5, a portion through which air flows is unlikely to be formed in the center of the ink flowing through the opening Op52. On the other hand, since the opening Op5 has the two openings Op51 and Op52, the area of the opening Op5 can be increased as compared with the mode in which the shape of the opening is a circle having the radius Ls5. As a result, a large amount of ink can be made to flow from the storage chamber 31 toward the filter chamber 71 through the first communication port 76*a* per unit time.

The longitudinal direction DL5 of the shape of the opening Op5 is perpendicular to the longitudinal direction Y of the liquid storage container 10E. The ink in the storage chamber 31 tends to be biased to any end of the liquid storage container 10E in the longitudinal direction Y due to the tilt of the liquid storage container 10E. However, with such a configuration, it is possible to prevent the formation of a portion through which air flows in the center of each of the openings Op51 and Op52 regardless of the direction of the tilt of the liquid storage container 10E.

The shape of the opening Op5 is symmetrical with respect to a straight line SA5 parallel to the longitudinal direction Y of the liquid storage container 10E. With such a configuration, the bias of the flowing liquid is reduced on both sides of the straight line SA5 of the opening Op5. Therefore, it is possible to prevent the formation of a portion through which air flows in the center of the opening Op5.

F. Sixth Embodiment

In a liquid storage container 10F according to a sixth embodiment, the cross-sectional shape of the flow path of a first communication port 76*a* is different from that of the liquid storage container 10A according to the first embodiment. Other points are the same as the liquid storage container 10A according to the first embodiment.

Figure 22:
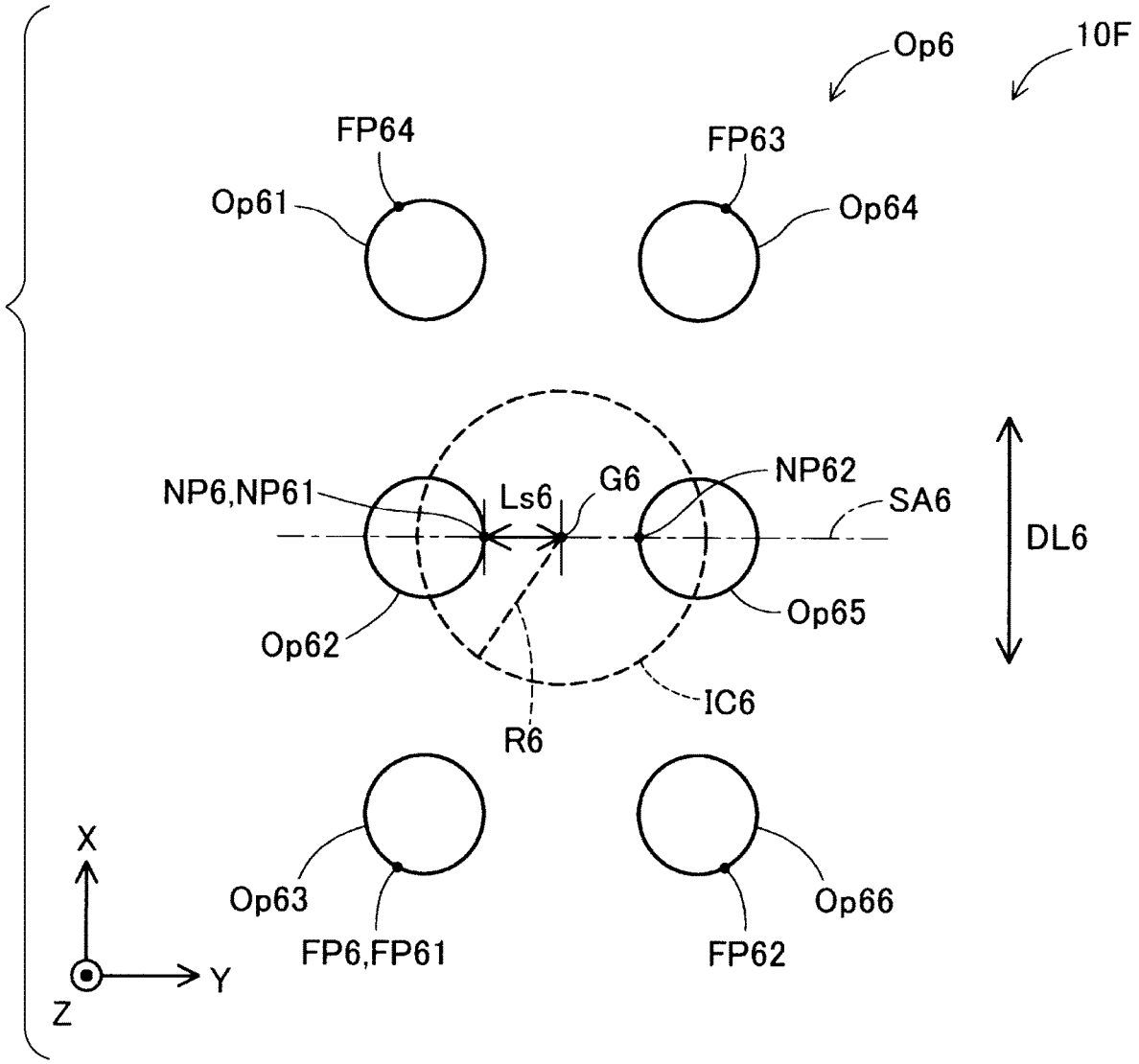
FIG. 22 is a plan view of a first communication port when viewed from inside a storage chamber in the −Z direction in a liquid storage container according to a sixth embodiment.

FIG. 22 is a plan view of a first communication port 76*a* when viewed from inside a storage chamber 31 in the −Z direction in a liquid storage container 10F according to a sixth embodiment. In the sixth embodiment, the first communication port 76*a* is provided with six openings Op61, Op62, Op63, Op64, Op65, and Op66 in the storage chamber 31. The entire opening including the six openings Op61, Op62, Op63, Op64, Op65, and Op66 is collectively described as an opening Op6.

The shapes of the openings Op61 to Op66 of the first communication port 76*a* in the storage chamber 31 are circular. The openings Op61 to Op63 are arranged side by side in the X direction in the partition wall 31*p*. The openings Op64 to Op66 are arranged side by side in the X direction. The openings Op61 and Op63 are arranged side by side in the Y direction. The openings Op62 and Op65 are arranged side by side in the Y direction. The openings Op63 and Op66 are arranged side by side in the Y direction. As a result, the shape of the opening Op6 including the openings Op61 to Op66 is a shape in which the X direction is a longitudinal direction DL6 and the Y direction is a lateral direction.

In the present embodiment, the shape of the opening Op6 of the first communication port 76*a* in the storage chamber 31 is a shape in which a distance Ls6 from the center of gravity G6 of the entirety of the opening Op6 to the closest points NP61 and NP62 in the contour defining the opening Op6 is smaller than a radius R6 of an imaginary circle IC6 having the same area as the area of the entirety of the opening Op6. When the points NP61 and NP62 are described without distinction, they are described as a point NP6.

Also in the present embodiment, compared with the mode in which the shape of the opening in the storage chamber 31 is the imaginary circle IC6 having the same opening area as the opening area of the opening Op6, even when the liquid level of the liquid in the storage chamber 31 approaches the partition wall 31*p*, a portion through which air flows is unlikely to be formed in the center of each of the openings Op61 to Op66. Therefore, the possibility that the liquid containing air bubbles is supplied to the liquid consumption device 500 can be reduced. A more specific description will be given below.

In the present embodiment, the shape of the opening Op6 includes proximity portions NP61 and NP62 where a distance to the center of gravity G6 of the opening Op6 is smaller than the radius R6 of the imaginary circle IC6 and remote portions FP61, FP62, FP63, and FP64 where a distance to the center of gravity G6 is larger than the radius R6 of the imaginary circle IC6. That is, the region of the imaginary circle IC6 includes a portion forming the partition wall 31*p* instead of the opening. The radius of each of the openings Op61 to Op66 is naturally smaller than the radius R6 of the imaginary circle IC6 having the same area as the area of the entirety of the opening Op6. When the points FP61, FP62, FP63, and FP64 are described without distinction, they are described as a point FP6.

As a result, in the opening Op61, since the distance between the portions located on both sides of the center of the circle, that is, the diameter, is smaller than the diameter of the imaginary circle IC6, a portion through which air flows is unlikely to be formed in the center of the ink flowing through the opening Op61. The same applies to the openings Op62 to Op66. On the other hand, since the opening Op6 has the six openings Op61 to Op66, the area of the opening Op6 can be increased as compared with the mode in which the shape of the opening is a circle having the radius Ls6. As a result, a large amount of ink can be made to flow from the storage chamber 31 toward the filter chamber 71 through the first communication port 76*a* per unit time.

The longitudinal direction DL6 of the shape of the opening Op6 is perpendicular to the longitudinal direction Y of the liquid storage container 10F. The ink in the storage chamber 31 tends to be biased to any end of the liquid storage container 10F in the longitudinal direction Y due to the tilt of the liquid storage container 10F. However, with such a configuration, it is possible to prevent the formation of a portion through which air flows in the center of each of the openings Op61 to Op66 regardless of the direction of the tilt of the liquid storage container 10F.

The shape of the opening Op6 is symmetrical with respect to a straight line SA6 parallel to the longitudinal direction Y of the liquid storage container 10F. With such a configuration, the bias of the flowing liquid is reduced on both sides of the straight line SA6 of the opening Op6. Therefore, it is possible to prevent the formation of a portion through which air flows in the center of the opening Op6.

G. Other Embodiments

G1. Another Embodiment 1

(1) In the first embodiment, the lengths of the line segments SL1 and SL2 defining the shape of the opening Op1 of the first communication port 76*a* in the storage chamber 31 are equal to each other (refer to FIG. 17). However, the length of the line segment defining the shape of the opening Op1 of the first communication port 76*a* in the storage chamber 31 may be longer on one side than on the other side. However, of the pair of line segments parallel to the longitudinal direction of the opening, it is preferable that the line segment on the +Y side is longer than the line segment on the −Y side. In such an embodiment, when the ink in the storage chamber 31 is consumed and the liquid level LL approaches the partition wall 31*p* in a state in which the posture of the liquid storage container 10A is tilted so that the +Y end of both ends in the Y direction is lower than the −Y end, it is more difficult to introduce air into the filter chamber.

(2) In the above embodiments, the shape of the opening of the first communication port 76*a* in the storage chamber 31 is a shape in which a distance from the center of gravity of the entirety of the opening to the closest point in the contour defining the opening is smaller than a radius of an imaginary circle having the same area as the area of the entirety of the opening. However, the shape of the opening of the second communication port 76*b* may be such a shape. That is, the shape of one or more openings of a communication hole structure in the storage chamber that allows the storage chamber and the filter chamber to communicate with each other may be the above shape.

(3) In the above embodiments, the first communication port 76*a* has a constant cross-sectional shape from the storage chamber 31 to the filter chamber 71. However, the first communication port as the communication hole structure may have an opening in the filter chamber having a shape different from the opening in the storage chamber. The communication hole structure can have an opening of any shape in the filter chamber. Further, the communication hole structure may be branched or merged in the partition wall.

(4) In the above embodiments, the liquid storage containers 10A to 10H are ink tanks to which an ink jet printer as a liquid consumption device is mounted. However, the liquid storage container may be applied to a liquid storage container mounted on a liquid consumption device other than an ink jet printer. For example, it may be applied to a liquid storage container mounted on a cleaning device that consumes a liquid detergent.

G2. Another Embodiment 2

In the first to fourth embodiments, the first communication port 76*a* has one opening Op1 in the storage chamber 31 (refer to FIGS. 17 to 20). However, the communication hole structure may have a plurality of openings as in the fifth and sixth embodiments. The number of openings can be any number such as 3, 4, 5, and 8. The plurality of openings forming the communication hole structure can have a mode in which a distance between the centers of gravity of the respective openings is within 5 times the radius of the imaginary circle having the same area as the total area of the plurality of openings, and the distance is more preferably within 3 times the radius of the imaginary circle.

G3. Another Embodiment 3

In the first embodiment, the shape of the opening Op1 is defined by a pair of line segments SL1 and SL2 having the same length arranged in parallel and a pair of arcs Ac1 and Ac2 connecting two sets of ends of the pair of line segments SL1 and SL2, respectively. However, the shape of the opening Op1 may be another shape, for example, one or both of the arcs Ac1 and Ac2 are composed of line segments.

G4. Another Embodiment 4

In the first, second, fifth, and sixth embodiments, the longitudinal directions DL1, DL2, DL5, and DL6 of the shapes of the openings Op1, Op2, Op5, and Op6 are perpendicular to the longitudinal direction Y of the liquid storage container 10A (refer to FIGS. 17, 18, 21, and 22). However, the longitudinal direction of the shape of the opening may be parallel to the longitudinal direction of the liquid storage container or may intersect the longitudinal direction of the liquid storage container at an angle other than 90°.

G5. Another Embodiment 5

In the embodiments, the shapes of the openings Op1 to Op6 are symmetrical with respect to the straight lines SA1 to SA6 parallel to the longitudinal direction Y of the liquid storage container 10A. However, the shape of the opening may be asymmetrical with respect to the straight line parallel to the longitudinal direction of the liquid storage container.

H. Yet Other Aspects

The present disclosure is not limited to the above-described embodiments, and can be realized in various modes without departing from the spirit thereof. For example, the present disclosure can also be realized in the following aspects. The technical features in the above embodiments corresponding to the technical features in each of aspects described below can be replaced or combined as appropriate in order to solve some or all of the problems of the present disclosure or to achieve some or all of the effects of the present disclosure. Further, if the technical feature is not described as essential in the present specification, it can be appropriately deleted.

(1) According to an aspect of the present disclosure, there is provided a liquid storage container. The liquid storage container is a liquid storage container that stores a liquid to be supplied to a liquid consumption device that consumes the liquid. The liquid storage container includes a storage chamber that stores a liquid, a filter chamber that is provided with a filter and receives the liquid from the storage chamber to filter the liquid by the filter, and a partition wall that separates the storage chamber and the filter chamber. The partition wall is provided with a communication hole structure that allows the storage chamber and the filter chamber to communicate with each other. A shape of one or more openings of the communication hole structure in the storage chamber is a shape in which a distance from a center of gravity of an entirety of the one or more openings to the closest point in a contour defining the one or more openings is smaller than a radius of a circle having the same area as an area of the entirety of the one or more openings.

With such a configuration, compared with the mode in which the shape of the opening of the communication hole structure in the storage chamber is circular, even when the liquid level of the liquid in the storage chamber approaches the partition wall, a portion through which air flows is unlikely to be formed in the center of the opening. Therefore, the possibility that the liquid containing air bubbles is supplied to the liquid consumption device can be reduced.

(2) In the liquid storage container according to the above aspect, the communication hole structure may have one opening in the storage chamber, and a shape of the one opening of the communication hole structure in the storage chamber may include a portion where a distance to the center of gravity is smaller than the radius of the circle and a portion where a distance to the center of gravity is larger than the radius of the circle.

(3) In the liquid storage container according to the above aspect, the shape of the one opening of the communication hole structure in the storage chamber may be defined by a pair of line segments having the same length arranged in parallel, and a pair of arcs connecting two sets of ends of the pair of line segments, respectively.

With such a configuration, a mold for producing the partition wall provided with the communication hole structure can be easily constructed.

(4) In the liquid storage container according to the above aspect, at least a portion of the one or more openings may have a shape having a longitudinal direction and a lateral direction, and the longitudinal direction of the shape may be perpendicular to a longitudinal direction of the liquid storage container.

With such a configuration, it is possible to prevent the formation of a portion through which air flows in the center of the opening regardless of the direction of the tilt of the liquid storage container.

(5) In the liquid storage container according to the above aspect, the shape of the one or more openings may be symmetrical with respect to a straight line parallel to the longitudinal direction of the liquid storage container.

Since the bias of the liquid flowing through the opening is reduced, it is possible to prevent the formation of a portion through which air flows in the center of the opening.

The present disclosure can also be realized in various modes of a liquid storage container. For example, it can be realized in modes of a partition wall structure of the liquid storage container, a communication hole structure of the liquid storage container, a method of manufacturing the liquid storage container, and the like.

The present disclosure is not limited to the above-described embodiments, other embodiments, examples, and modification examples, and can be realized by various configurations without departing from the spirit thereof. For example, the technical features in the embodiments, other embodiments, examples, and modification examples corresponding to the technical features in each of aspects described in the SUMMARY section can be replaced or combined as appropriate in order to solve some or all of the above-described problems or to achieve some or all of the above-described effects. In addition, the technical features are not limited to those described as not essential in the present specification, and if the technical feature is not described as essential in the present specification, it can be deleted as appropriate.

What is claimed is:

1. A liquid storage container that stores a liquid to be supplied to a liquid consumption device that consumes the liquid, the liquid storage container comprising:

a storage chamber that stores a liquid;

a filter chamber that is provided with a filter and receives the liquid from the storage chamber to filter the liquid by the filter; and a partition wall that separates the storage chamber and the filter chamber, wherein the partition wall is provided with only two single holes, including a first single hole and a second single hole, that allow the storage chamber and the filter chamber to communicate with each other, the first single hole and the second single hole being located at a first position and a second position, respectively, of the partition wall, the first position and the second position being two farthest positions from each other in plan view of the partition wall, and a shape of the first single hole in the storage chamber is a shape in which a distance from a center of gravity of an entirety of the first single hole to a closest point in a contour defining the first single hole is smaller than a radius of a circle having the same area as an area of the entirety of the first single hole.

2. The liquid storage container according to claim 1, wherein the shape of the first single hole in the storage chamber is defined by a pair of line segments having the same length arranged in parallel, and a pair of arcs connecting two sets of ends of the pair of line segments, respectively.

3. The liquid storage container according to claim 1, wherein the single hole has a shape having a longitudinal direction and a lateral direction, the portion being longer in the longitudinal direction than in the lateral direction, and the longitudinal direction of the shape is perpendicular to a longitudinal direction of the liquid storage container.

4. The liquid storage container according to claim 3, wherein the shape of the first single hole is symmetrical with respect to a straight line parallel to the longitudinal direction of the liquid storage container.

* * * * *